US008805222B2

(12) United States Patent
Nakatake et al.

(10) Patent No.: US 8,805,222 B2
(45) Date of Patent: Aug. 12, 2014

(54) IMAGE DEVELOPING DEVICE, PROCESS CARTRIDGE INCLUDING IMAGE DEVELOPING DEVICE, AND IMAGE FORMING DEVICE INCLUDING IMAGE DEVELOPING DEVICE

(75) Inventors: Naoki Nakatake, Hyogo (JP); Tomohiro Kubota, Osaka (JP); Shoh Tsuritani, Osaka (JP); Yuji Nagatomo, Osaka (JP); Yasuhide Matsuno, Osaka (JP); Hiroaki Katoh, Kyoto (JP); Tomoya Adachi, Hyogo (JP); Rumi Miyazaki, Osaka (JP); Takafumi Miyazaki, Osaka (JP); Takeshi Yamashita, Osaka (JP); Kyoko Abe, Osaka (JP); Yasuhiro Fujiwara, Osaka (JP); Takahiro Sanada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 37 days.

(21) Appl. No.: 13/697,020

(22) PCT Filed: Mar. 5, 2012

(86) PCT No.: PCT/JP2012/056210

§ 371 (c)(1),
(2), (4) Date: Nov. 9, 2012

(87) PCT Pub. No.: WO2012/124645

PCT Pub. Date: Sep. 20, 2012

(65) Prior Publication Data

US 2013/0058670 A1 Mar. 7, 2013

(30) Foreign Application Priority Data

Mar. 14, 2011 (JP) ..... 2011-055969
Nov. 7, 2011 (JP) ..... 2011-243029

(51) Int. Cl.
*G03G 15/08* (2006.01)

(52) U.S. Cl.
USPC ..... 399/53; 399/27

(58) Field of Classification Search
None
See application file for complete search history.

(56) References Cited

U.S. PATENT DOCUMENTS 4,646,679 A 3/1987 Ohno et al.
5,365,319 A 11/1994 Sakemi et al.

(Continued)

FOREIGN PATENT DOCUMENTS

JP 63-149677 6/1988
JP 4-019768 1/1992

(Continued)

OTHER PUBLICATIONS

U.S. Appl. No. 13/554,270, filed Jul. 20, 2012, Tsuritani.

(Continued)

*Primary Examiner* — Clayton E LaBalle
*Assistant Examiner* — Jas Sanghera
(74) *Attorney, Agent, or Firm* — Oblon, Spivak, McClelland, Maier & Neustadt, L.L.P.

(57) ABSTRACT

An image developing device includes a developer supporting body; a first conveyance path in which a first conveyance member is arranged; a second conveyance path in which a second conveyance member is arranged; and a partition member that partitions the first conveyance path and the second conveyance path and that has a first communication port and a second communication port. The first communication path and the second communication path communicates with each other through the first communication port and the second communication port. The image developing device includes a developer amount detection unit that includes an optical detection unit arranged in the second conveyance path and that optically detects an amount of the developer in the image forming device. The developer is caused to accumulate in the vicinity of the developer amount detection unit.

18 Claims, 11 Drawing Sheets

(56) References Cited

U.S. PATENT DOCUMENTS

| | | | | |
|---|---|---|---|---|
| 2006/0115302 | A1 | 6/2006 | Hosokawa et al. | |
| 2007/0281232 | A1 | 12/2007 | Yoshimura | |
| 2008/0145108 | A1 | 6/2008 | Yoshida et al. | |
| 2008/0145109 | A1 | 6/2008 | Murayama et al. | |
| 2008/0145119 | A1 | 6/2008 | Tatsumi et al. | |
| 2008/0253810 | A1* | 10/2008 | Tateyama et al. | 399/258 |
| 2009/0074439 | A1 | 3/2009 | Kasai | |
| 2009/0162101 | A1 | 6/2009 | Yoshida et al. | |
| 2009/0169265 | A1 | 7/2009 | Yoshida et al. | |
| 2010/0014895 | A1 | 1/2010 | Hosokawa et al. | |
| 2010/0028053 | A1* | 2/2010 | Kasai | 399/255 |
| 2012/0033982 | A1 | 2/2012 | Kubota et al. | |

FOREIGN PATENT DOCUMENTS

| | | |
|---|---|---|
| JP | 5-341654 | 12/1993 |
| JP | 6-308833 | 11/1994 |
| JP | 10-149027 | 6/1998 |
| JP | 2003-043798 | 2/2003 |
| JP | 2006-178405 | 7/2006 |
| JP | 2007-322653 | 12/2007 |
| JP | 2009-069447 | 4/2009 |
| JP | 2010-066769 | 3/2010 |
| JP | 2011-002526 | 1/2011 |
| JP | 4709029 | 6/2011 |
| KR | 10-0915396 | 9/2009 |

OTHER PUBLICATIONS

International Search Report Issued Apr. 10, 2012 in PCT/JP2012/056210 Filed on Mar. 5, 2012.

Korean Office Action issued Feb. 27, 2014, in Korea Patent Application No. 10-2012-7029453.

Extended European Search Report mailed on Apr. 4, 2014, in counterpart European Appln No. 12 75 8255 (4 pages).

* cited by examiner

IMAGE DEVELOPING DEVICE, PROCESS CARTRIDGE INCLUDING IMAGE DEVELOPING DEVICE, AND IMAGE FORMING DEVICE INCLUDING IMAGE DEVELOPING DEVICE

TECHNICAL FIELD

Embodiments of the present invention relate to an image developing device that develops a latent image on a latent image supporting body by using a developer supporting body that supports developer, and a process cartridge and an image forming device that utilize the image developing device.

BACKGROUND ART

Image forming devices that utilize the electrographic method have been widely used, for example in home offices, or by general users. In order to respond to such utilization in the home offices or by the general users, cost reduction, a longer life-span, downsizing, and stability during operation may be required. In order to realize a longer life-span of an image forming device, wearing of functional materials associated with their use may be minimized. For example, for a photosensitive body, which is an image supporting body, surface wear caused by being contacted by corresponding members in a charging process, a developing process, a transferring process, and a cleaning process, respectively, may be considered. It has been known to provide a suppressive measure for suppressing the wear, such as an application member for applying a lubricant agent, so as to prevent a surface of a photosensitive body from being worn. However, as the photosensitive body is downsized in accordance with the downsizing of the device, it is becoming difficult to arrange such a suppressive measure for suppressing the wear. Therefore, recently, various methods are considered such that an outer additive agent including a lubricant component is added to toner and a friction coefficient of the surface of the photosensitive body is reduced.

On the other hand, in order to stabilize the long term operation of the developing device, an amount of the toner corresponding to the amount of the toner consumed during the image development may be supplied. Since the amount of the toner stored in the developing unit is reduced as the developing unit is used, a residual quantity detection unit may be utilized to detect whether the remaining amount of the developer is greater than or equal to a predetermined amount. It has been known to supply the toner based on a detection result by such a residual quantity detection unit. For example, Patent Document 1 (Japanese Published Unexamined Application No. 2011-002526) discloses a two-axis developer circulation type image developing device such that two developer conveyance members are arranged at an upper portion and at a lower portion of a developing unit storing a one-component developing agent. A developer reservoir is continuously provided at an upper portion of an extending portion of the upper developer conveyance member, which is an upstream end portion in the conveyance direction. A residual amount detection unit is arranged at the developer reservoir. The residual amount detection unit optically detects a surface of the developer through a translucent detection window arranged at a side wall of the developer reservoir. With this, the residual amount detection unit determines the residual quantity of the developer.

However, when an outer additive agent including a lubricant component is added to toner, an adhesive force between particles of the toner increases and a cohesive property of the toner is increased. Thus the fluidity of the toner is reduced. When the fluidity of the toner is reduced, the surface of the toner tends to be uneven and the surface of the toner tends not to be formed stably at a suitable position corresponding to the amount of the developer. Therefore, the detected amount of the toner detected by the residual amount detection unit that optically detects the surface of the developer through the detection window tends to be varied. For example, the residual amount detection unit may not detect the surface of the developer when the residual amount of the developer is less than or equal to the predetermined amount, or the residual amount detection unit may detect the surface of the developer when the residual amount of the developer is greater than the predetermined amount. Consequently, the image may be blurred because of the insufficient amount of the toner, or the clogging of the toner may occur because of the overflow of the toner.

It is an objective of the image developing device disclosed in Patent Document 1 to detect a residual amount of the developer within the developing unit by a simple and less expensive configuration. However, in this case, the image developing device tends to be large because the developer reservoir is continuously arranged at the upper portion of the extending unit of the upper developer conveyance member. Thus such a configuration is not suitable for downsizing of the device. Further, in order to detect the residual amount of the developer, an amount of the developer that reaches the developer reservoir may always be required. Therefore, a greater amount of the developer may be required and the cost is increased. Further, when a developer having a low fluidity is used so as to respond to the longer life-span, an excessive amount of the developer within the developing unit may lead to a breakage of the developer conveyance member that is caused by a torque load, or a destruction of the device that is caused by the clogged toner.

The embodiment of the present invention is developed in view of the above problems. An objective of the embodiment is to provide an image developing device, a process cartridge which utilizes the image developing device, and an image forming device which utilizes the image developing device that can properly detect an amount of a developer within the image developing device, that can prevent an image from being blurred due to an erroneous detection, that can prevent clogging of toner, and that can maintain high image quality for a long time, when a developer having a low fluidity is utilized so as to respond to a longer life-span.

SUMMARY OF THE INVENTION

Means for Solving the Problems

In one aspect, there is provided an image developing device including a developer supporting body that supports a developer and that conveys the developer to a portion facing a latent image supporting body; a first conveyance path in which a first conveyance member is arranged, the first conveyance member being for conveying the developer along an axis line direction of the developer supporting body; a second conveyance path in which a second conveyance member is arranged, the second conveyance path being for conveying the developer in a direction opposite to the developer conveyance direction by the first conveyance member, the second conveyance member being arranged above the first conveyance path; and a partition member that partitions the first conveyance path and the second conveyance path and that has a first communication port and a second communication port, the first communication path and the second communication path communicating with each other at a first end portion and a second end portion in the axis line direction through the first communication port and the second communication port. The image developing device includes a developer amount detection unit that includes an optical detection unit arranged in the second conveyance path and that optically detects an amount of the developer in the image forming device. The developer is caused to accumulate in the vicinity of the developer amount detection unit of the image developing device.

In another aspect, there is provided a process cartridge that is detachably attached to an image forming device, the process cartridge integrally supporting a latent image supporting body that supports a latent image; and at least one of units selected from a charging unit that uniformly charges the latent image supporting body; a developing unit that develops the latent image on the latent image supporting body; and a cleaning unit that cleans the latent image supporting body. The process toner cartridge includes an image developing device that includes a developer supporting body that supports a developer and that conveys the developer to a portion facing a latent image supporting body; a first conveyance path in which a first conveyance member is arranged, the first conveyance member being for conveying the developer along an axis line direction of the developer supporting body; a second conveyance path in which a second conveyance member is arranged, the second conveyance path being for conveying the developer in a direction opposite to the developer conveyance direction by the first conveyance member, the second conveyance member being arranged above the first conveyance path; and a partition member that partitions the first conveyance path and the second conveyance path and that has a first communication port and a second communication port, the first communication path and the second communication path communicating with each other at a first end portion and a second end portion in the axis line direction through the first communication port and the second communication port. The image developing device includes a developer amount detection unit that includes an optical detection unit arranged in the second conveyance path and that optically detects an amount of the developer in the image forming device. The developer is caused to accumulate in the vicinity of the developer amount detection unit of the image developing device.

In another aspect, there is provided an image forming device including a latent image supporting body that supports a latent image; and an image developing unit that develops the latent image on the latent image supporting body. The image developing device includes a developer supporting body that supports a developer and that conveys the developer to a portion facing a latent image supporting body; a first conveyance path in which a first conveyance member is arranged, the first conveyance member being for conveying the developer along an axis line direction of the developer supporting body; a second conveyance path in which a second conveyance member is arranged, the second conveyance path being for conveying the developer in a direction opposite to the developer conveyance direction by the first conveyance member, the second conveyance member being arranged above the first conveyance path; and a partition member that partitions the first conveyance path and the second conveyance path and that has a first communication port and a second communication port, the first communication path and the second communication path communicating with each other at a first end portion and a second end portion in the axis line direction through the first communication port and the second communication port. The image developing device includes a developer amount detection unit that includes an optical detection unit arranged in the second conveyance path and that optically detects an amount of the developer in the image forming device. The developer is caused to accumulate in the vicinity of the developer amount detection unit of the image developing device.

In the embodiment, the developer in the first conveyance path is conveyed along the axis direction of the developer supporting body by the first conveyance member, and the developer is lifted to the second conveyance path through the second communication port. The developer in the second conveyance path is conveyed in the direction opposite to the conveyance direction in the first conveyance path by the second conveyance member, and the developer is dropped and returned to the first conveyance path through the first communication port. In this manner, the developer circulates between the first conveyance path and the second conveyance path. At that time, since the developer tends to accumulate around the detection unit of the developer amount detection unit arranged inside the second conveyance path, the developer surface in the second conveyance path is formed to be slanted so that a height of the developer surface is increased along a direction from an upstream side portion in the developer conveyance direction toward the detection unit of the developer amount detection unit. Therefore, even if a developer having a low fluidity is utilized, unevenness of the surface of the developer in the vicinity of the detection unit can be reduced, in comparison to a conventional configuration in which the developer tends not to accumulate in the vicinity of the detection unit. Thus the developer surface can be formed at a more suitable position depending on the amount of the developer. Hence the developer amount detection unit can detect the developer surface formed at the more suitable position, depending on the amount of the developer.

According to the embodiment, the developer amount detection unit can detect the developer surface formed at the more suitable position compared to a position in a conventional case, depending on the amount of the developer. Therefore, even if a developer having a low fluidity is utilized so as to respond to a longer life-span, an amount of the developer within the device can be more properly detected. Consequently, an image developing device, a process cartridge which utilizes the image developing device, and an image forming device which utilizes the image developing device can be provided such that blurring of an image and clogging of the toner due to an erroneous detection are prevented, and with which high image quality can be maintained for a long time.

DESCRIPTION OF THE REFERENCE NUMERALS

Figure 1:
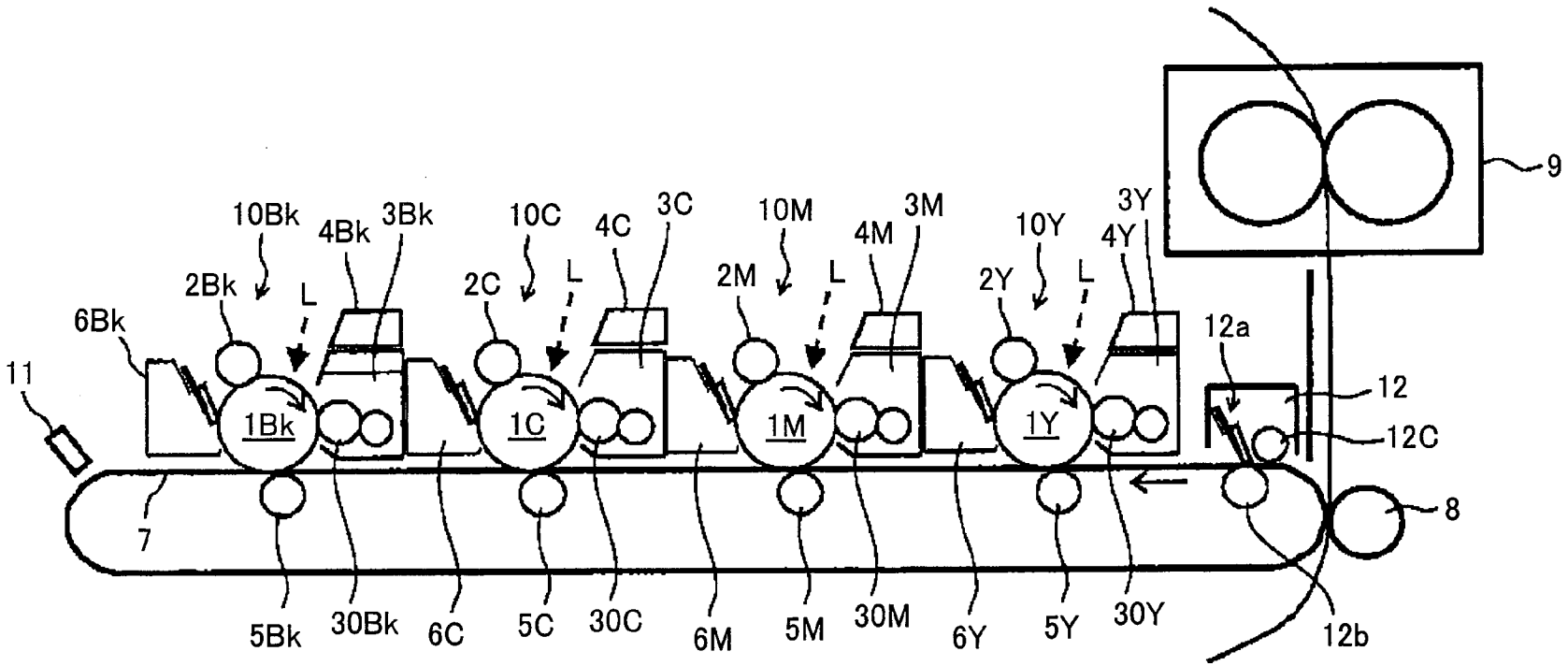
FIG. 1 is a configuration diagram illustrating configurations of main parts of a printer according to an embodiment.

1 Photosensitive body
2 Charging roller
3 Image developing device
4 Toner supply container
5 Transfer roller
6 Cleaning unit
7 Intermediate transfer belt
8 Secondary transfer roller
9 Fixing device
10 Image forming unit
11 Sensor
12 Belt cleaning unit
12*a* Cleaning blade
12*b* Metal cleaning opposite roller
12*c* Conveyance coil
30 Image developing roller
31 Lower conveyance member
32 Lower tank
33 Upper conveyance member
34 Upper tank
34*a* Side wall
35 Feed roller
36 Partition member
37 First communication port
38 Second communication port
39 Regulating member
41 Agitator
41*a* Rotation axis
41*b* PET Film
42 Toner conveyance member
50 Drive transmission unit
51 Optical sensor
52 First optical guide
53 Second optical guide
54 Cleaning member
61*a* Light beam
61*b* Space
62 Light emitting plane
63 Entrance plane
71 Upstream rib
72 Downstream rib

MODE FOR CARRYING OUT THE INVENTION

First Embodiment

Figure 2:
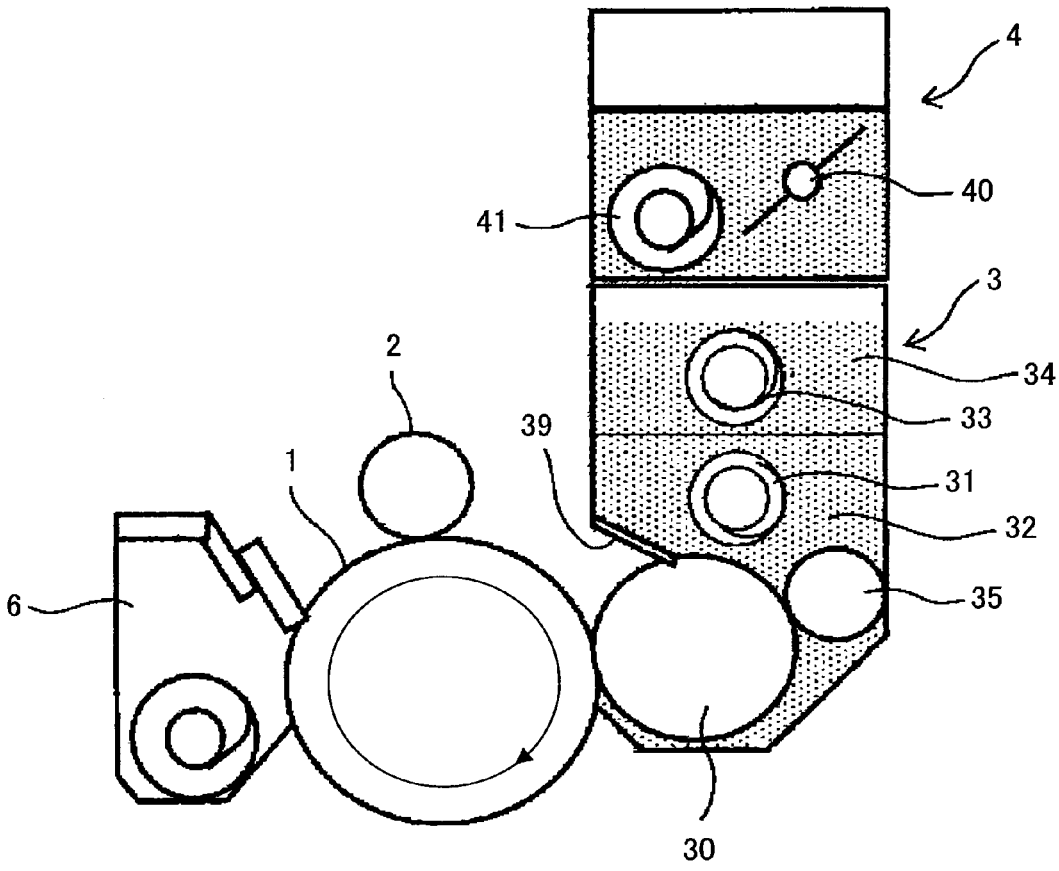
FIG. 2 is a schematic configuration diagram illustrating a configuration of an image forming unit of the printer.

Hereinafter, an embodiment (referred to as the first embodiment) applied to a color printer, which is an image forming device utilizing an electrographic method, is explained. FIG. 2 is a configuration diagram illustrating configurations of major portions of the printer according to the first embodiment. As shown in FIG. 1, in the printer, four image forming units 10C, 10Y, 10M, and 10Bk, which form a yellow toner image, a magenta toner image, a cyan toner image, and a black toner image, respectively, are arranged in parallel and evenly spaced apart by a predetermined distance along an intermediate transfer belt 7, which is horizontally extended. Hereinafter, the suffixes C, Y, M, Bk indicate colors of cyan, yellow, magenta, and black, respectively. Since the configurations of the four image forming units 10C, 10Y, 10M, and 10Bk are the same except for the colors, the suffixes are sometimes abbreviated in the explanation below. The image forming units 10C, 10Y, 10M, and 10Bk include corresponding photosensitive bodies 1C, 1Y, 1M, and 1Bk, respectively. Each of the photosensitive bodies 1C, 1Y, 1M, and 1Bk is an image supporting body that rotates in the clockwise direction in FIG. 1. In the surrounding areas of the photosensitive bodies 1C, 1Y, 1M, and 1Bk, corresponding charging rollers 2C, 2Y, 2M, and 2Bk; corresponding image developing devices 3C, 3Y, 3M, and 3Bk; corresponding transfer rollers 5C, 5Y, 5M, and 5Bk; and corresponding cleaning units 6C, 6Y, 6M, and 6Bk are arranged in this order, respectively. Further, corresponding exposure devices (not shown) are arranged above the image forming units 10. The above described charging rollers 2 are arranged to contact surfaces of the photosensitive bodies 1 or arranged in proximity to the surface of the photosensitive bodies 1, respectively. Each of the charging rollers 2 causes the corresponding photosensitive body 1 to be charged in a predetermined polarity and in a predetermined voltage by applying a bias voltage. For each of the above described exposure devices, a LD or LED is used as a light-emitting element. The exposure devices irradiate corresponding light beams L, which are modulated based on image data, onto the corresponding photosensitive bodies 1, which are charged by the charging roller 2. In this manner, electrostatic latent images are formed on the corresponding photosensitive bodies 1.

Each of the above described image developing devices 3 develops an image by performing a contact development method while utilizing a single component developer that includes toner. As described later, in each of the image developing devices 3, a corresponding image developing roller 30, which supports and conveys the developer in the image developing device 3 to a portion facing the corresponding photosensitive body 1, is arranged at a corresponding opening of the image developing device 3 facing the corresponding photosensitive body 1. In each of the image developing devices 3, charged toner is adhered, by a voltage difference between the developing bias applied to the corresponding developing roller 30 and the electrostatic latent image formed on the surface of the corresponding photosensitive body 1, to an electrostatic latent image within an area to be developed. In this manner, the electro static latent images are developed. Further, a toner supply container 4 for supplying the corresponding color of toner to the corresponding image developing device 3 is connected to an upper portion of the corresponding image developing device 3. Here, each of the image developing devices 3 is configured to utilize the single component developer. However, each of the developing devices 3 may be configured to utilize developer having two components. Further, each of the toner supply containers 4 has a configuration such that the toner supply container 4 directly supplies the corresponding color of toner into the corresponding image developing device 3. However, each of the toner supply containers 4 may not be connected to the upper portion of the corresponding image developing device 3, and the toner supply container 4 may have a configuration such that the corresponding color of toner is supplied to the corresponding image developing device 3 through a supply path arranged within the printer.

The above described intermediate transfer belt 7 is supported by plural conveyance rollers (not shown) including a driving roller. The intermediate transfer belt 7 can be moved in a clockwise direction in FIG. 1. The intermediate transfer belt 7 is sandwiched between each pair of the above described transfer rollers 5 and the corresponding photosensitive body 1, and each of the transfer rollers 5 is facing the corresponding photosensitive body 1. When the toner images are transferred, each of the transfer rollers 5 is contacted with the surface of the corresponding photosensitive body 1 by a predetermined pressing force, and an electric voltage is applied to the transfer roller 5. Then, at a transfer nip portion which is nipped between the transfer roller 5 and the corresponding photosensitive body 1, the toner image on the surface of the corresponding photosensitive body 1 is transferred onto the intermediate transfer belt 7. The toner images on the photosensitive bodies 1, which are developed by the image forming units 10C, 10Y, 10M, and 10Bk, respectively, are sequentially transferred onto the intermediate transfer belt 7 by the corresponding transfer rollers 5 and superimposed. Further, a secondary transfer roller 8 is arranged at a downstream side in the moving direction of the intermediate transfer belt 7 with respect to the image forming units 100, 10Y, 10M, and 10Bk. The yellow image, the cyan image, the magenta image, and the black image, which are transferred onto and superimposed on the intermediate transfer belt 7, are transferred in bundles onto a recording paper by the secondary transfer roller 8. The recording paper, on which the toner images are transferred, is conveyed to a fixing device 9. Then the recording paper is heated and pressed, and the toner images are fixed onto the recording paper. After that, the recording paper is ejected from a paper ejection port (not shown).

Further, a sensor 11 is arranged in the surrounding area of the intermediate belt 7. This sensor 11 (such as an optical sensor, for which the specular reflection method and the diffusion reflection method are combined) measures an amount of the toner transferred and adhered to the intermediate transfer belt 7 and positions of the toner images in the corresponding colors. The data obtained by the sensor 11 is used for adjusting image density and the positions. Further, a belt cleaning unit 12 is arranged in the surrounding area of the intermediate transfer belt 7. The belt cleaning unit 12 cleans the intermediate transfer belt 7 after the secondary transfer has been completed. The belt cleaning unit 12 includes a cleaning blade 12*a* and a metal cleaning opposite roller 12*b*. The cleaning blade 12*a* slidably contacts with the intermediate transfer belt 7 such that the cleaning blade 12*a* is inclined in the direction opposite to the moving direction of the intermediate transfer belt 7. The metal cleaning opposite roller 12*b* and the cleaning blade 12*a* nip the intermediate transfer belt 7. The metal cleaning opposite roller 12*b* is arranged at a position facing the cleaning blade 12*a* through the intermediate transfer belt 7. The toner removed by the cleaning blade 12*a* of the belt cleaning unit 12 is transferred by a conveyance coil 12*c* and stored in a waste toner storage unit (not shown).

FIG. 2 is a schematic configuration diagram illustrating a configuration of the image forming unit 10. As shown in FIG. 2, the image forming unit 10 is a process cartridge, which integrally includes the photosensitive body 1, the charging roller 2, the image developing device 3, the toner supply container 4, and the cleaning unit 6. The image forming unit 10 is detachably attached to the main body of the image forming device. Here, the image forming unit 10 is detachably attached to the main body, but the configuration is not limited to this. For example, each of the photosensitive body 1, the charging roller 2, the image developing device 3, the toner supply container 4, and the cleaning unit 6 may be replaced with a new one as a unit.

Figure 3:
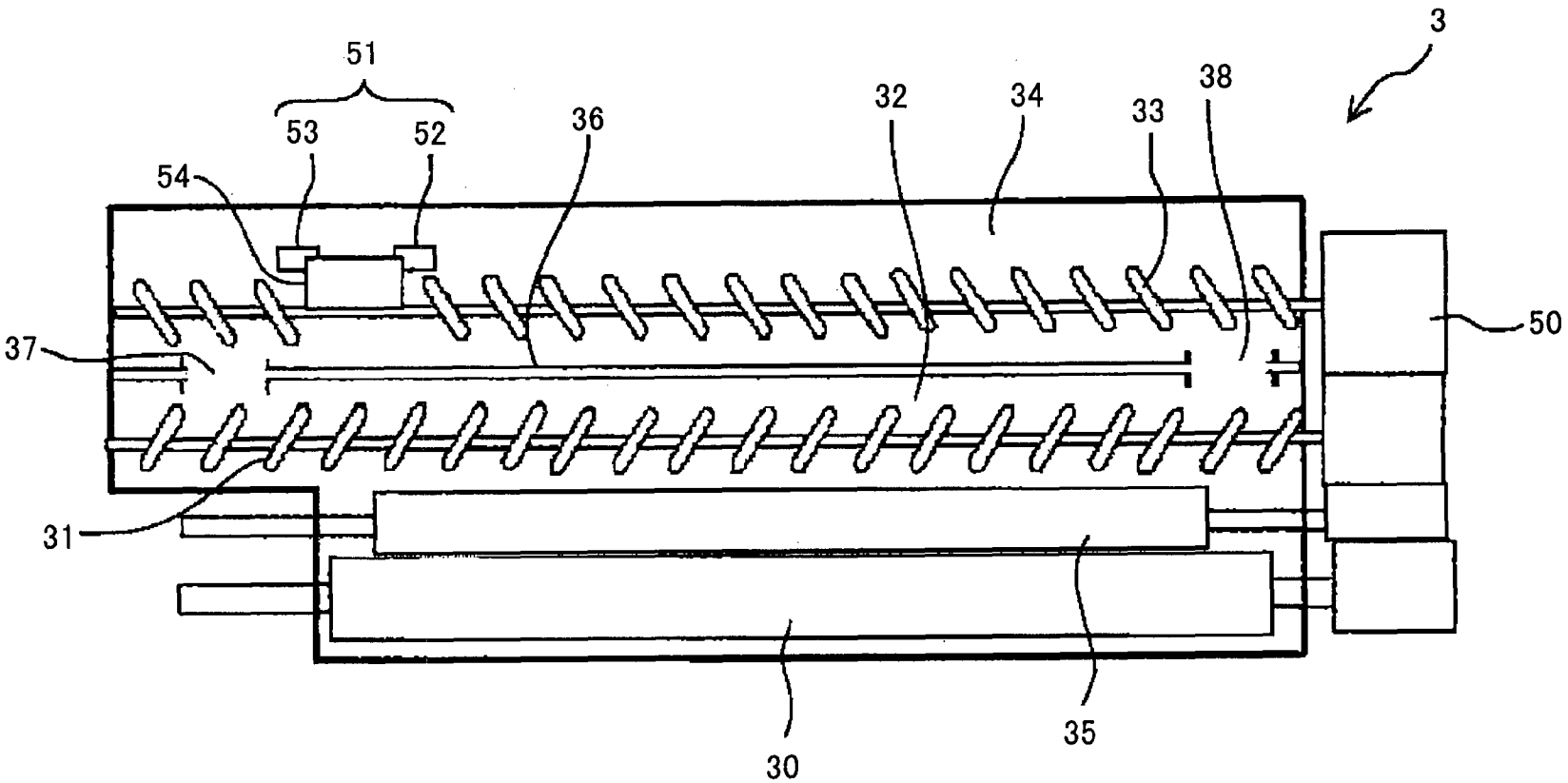
FIG. 3 is a schematic configuration diagram illustrating an internal configuration of an image developing device of the printer.

Next, the above image developing device 3 is explained in detail. FIG. 3 is a schematic configuration diagram illustrating an internal configuration of the image developing device 3. As shown in FIGS. 2 and 3, the image developing device 3 includes therein a lower tank 32 and an upper tank 34. The lower tank 32 stores the toner, which is supplied to the image developing roller 30. Further, the lower tank 32 includes a lower conveyance member 31 which is a first conveyance member that conveys the toner along an axis line direction of the image developing roller 30. The lower tank 32 forms a first conveyance path. The upper tank 34 includes an upper conveyance member 33, which is placed above the lower tank 32, and which is a second conveyance member that conveys the stored toner in the direction that is opposite to the conveyance direction of the lower conveyance member 31. The upper tank 34 forms a second conveyance path. The lower conveyance member 31 and the upper conveyance member 33 are driven by a driving source included, for example, in the main body of the image forming device through a drive transmission unit 50 including, for example, a gear and shaft coupling. The lower tank 32 and the upper tank 34 are partitioned by a partition member 36. The lower tank 32 and the upper tank 34 communicate with each other through a first communication port 37 and a second communication port 38, which are formed at end portions in the axis direction of the partition member 36, respectively. The toner supplied from the toner supply container 4 to the image developing device 3 is conveyed in the left direction in FIG. 3 along the axis direction of the image developing roller 30 by the upper conveyance member 33. Then the toner collides with an inner wall and falls down through the first communication port 37. In this manner, the toner moves into the lower tank 32. The toner in the lower tank 32 is conveyed in the right direction in FIG. 3 along the axis direction of the image developing roller 30 by the lower conveyance member 31. Then the toner collides with another inner wall and moves into the upper tank 34 through the second communication port 38. In this manner, the toner inside the image developing device 3 can circulate between the upper tank 34 and the lower tank 32 through the first communication port 37 and the second communication port 38 in the longitudinal direction of the partition member 36.

Further, the lower tank 32 of the above described image developing device includes, at least, a feed roller 35 and a regulating member 39, in addition to the image developing roller 30 and the lower conveyance member 31. Here, the feed roller is formed of an elastic body, such as a sponge, and feeds the toner inside the lower tank 32 onto the image developing roller 30. The regulating member 39 regulates an amount of the toner on the image developing roller 30. The feed roller 35 applies and feeds the toner, which is adhered to the surface of the feed roller 35 when the feed roller 35 rotates, onto the surface of the image developing roller 30. A supply bias having a value, which is offset with respect to the developing bias in the same direction as the charging polarity of the toner, may be applied to the feed roller 35. The supply bias acts in a direction to press the toner onto the image developing roller 30. Here, the toner is pre-charged at a portion of the image developing roller 30, where the toner contacts the image developing roller 30. The developing bias is applied to the image developing roller 30 so as to form an electric field between the image developing roller 30 and the photosensitive body 1. The image developing roller 30 rotates in the counterclockwise direction in FIG. 3. The image developing roller 30 conveys the toner, which is supported on the surface of the image developing roller 30, toward the regulating member 39 and to a position where the image developing roller 30 faces the photosensitive body 1. A free end side of the regulating member 39 slidably contacts the surface of the image developing roller 30 by a predetermined pressing force. The regulating member 39 causes the toner, which has been passed through the pressing force, to become a thin layer, and adds an electric charge to the toner by frictional charging. A regulating bias having a value, which is offset with respect to the developing bias in the same direction as the charging polarity of the toner, may be applied to the regulating member 30, so as to support the frictional charging. The toner, which has become the thin layer, is conveyed to the position, where the image developing roller 30 is facing the photosensitive body 1, by the rotation of the image developing roller 30. Then the toner moves onto the surface of the photosensitive body 1, depending on the developing bias applied to the image developing roller 30 and a latent image electric field generated by the electrostatic latent image on the photosensitive body 1. The toner, which has not been developed on the photosensitive body 1 and is remaining on the image developing roller 30, is removed from the image developing roller 30 and retrieved by the feed roller 35. The toner removed from the image developing roller 30 is conveyed to the upper tank 34 through the second communication port 38 by the lower conveyance member 31.

In the image developing device 3 shown in FIG. 3, each of the lower conveyance member 31 and the upper conveyance member 33 is formed to be a screw that conveys the toner in one direction. However, the configuration of the image developing device 3 is not limited to this. For example, a reverse conveyance unit that conveys the toner in the direction opposite to the conveyance direction of the toner may be arranged at the downstream end portion in the toner conveyance direction. At the downstream sides in the conveyance direction of the toner in the lower tank 32 and in the upper tank 34, the flow of the toner is blocked by the inner walls. However, by applying a reverse driving force, which is in the direction opposite to the conveyance direction of the toner, to the toner using the reverse conveyance unit, the toner may be prevented from clogging.

Figure 4:
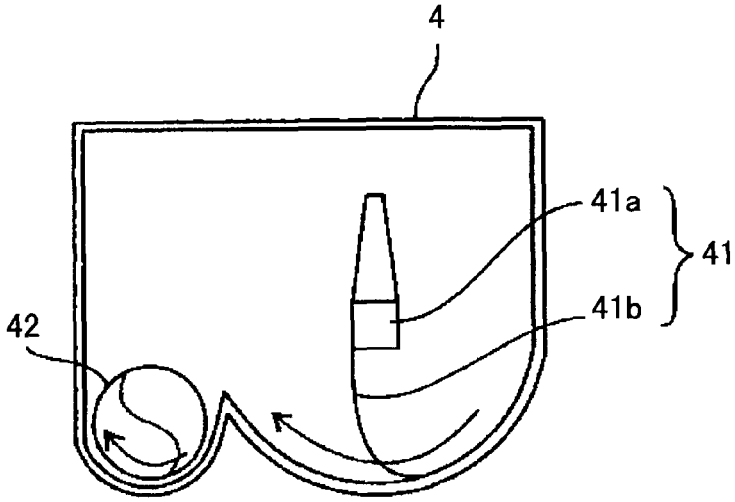
FIG. 4 is a configuration diagram illustrating a configuration of a toner supply container of the printer.

FIG. 4 is a configuration diagram illustrating the toner supply container 4. As shown in FIGS. 2 and 4, the toner supply container 4 arranged at the upper portion of the image developing device 3 includes a toner conveyance member 42 that conveys the toner to a toner supply port (not shown) inside the toner supply container 4. As shown in FIG. 4, an agitator 41 includes, for example, a rotation axis 41*a* and a flexible material, such as a PET film 41*b*, which is fixed to the rotation axis 41*a*. The agitator 41 ensures the fluidity of the toner filled in the toner supply container 41 by rotation, and supplies the toner toward the toner conveyance member 42. It is preferable that the toner supply container 4 have an arc shape along the rotational trajectory of the agitator 41, so as to use up the toner inside the toner supply container 4. The toner conveyance member 42 is a member formed of, for example, a screw and a coil. The toner conveyance member 42 is connectable to a driving unit (not shown) which is arranged at the side of the main body of the image forming device. Connection and disconnection between the toner conveyance member and the driving unit are controlled by a known method, such as a clutch, so that the driving for supplying the toner can be freely performed as desired. It is preferable that the toner conveyance member 42 be controlled by a known method such that, when an optical sensor (described later) arranged in the image developing device 3 detects that the toner is running short, the toner conveyance member 42 starts rotational operation, and when the optical sensor detects that the toner is fully loaded, the toner conveyance member 42 stops the rotational operation, so as to stabilize the amount of the toner inside the image developing device 3. The amount of the toner supplied by the toner conveyance member 42 can be controlled by varying, for example, a driving time of the driving unit, a pitch diameter of the toner conveyance member 42, a size of the toner conveyance member 42, and a rotational speed. Further, the toner conveyance member 42 may be controlled in such a way that the driving time of the toner conveyance member 42 is varied in response to a change in the liquidity of the toner caused by, for example, a change of the temperature and humidity in the surrounding environment.

Figure 5:
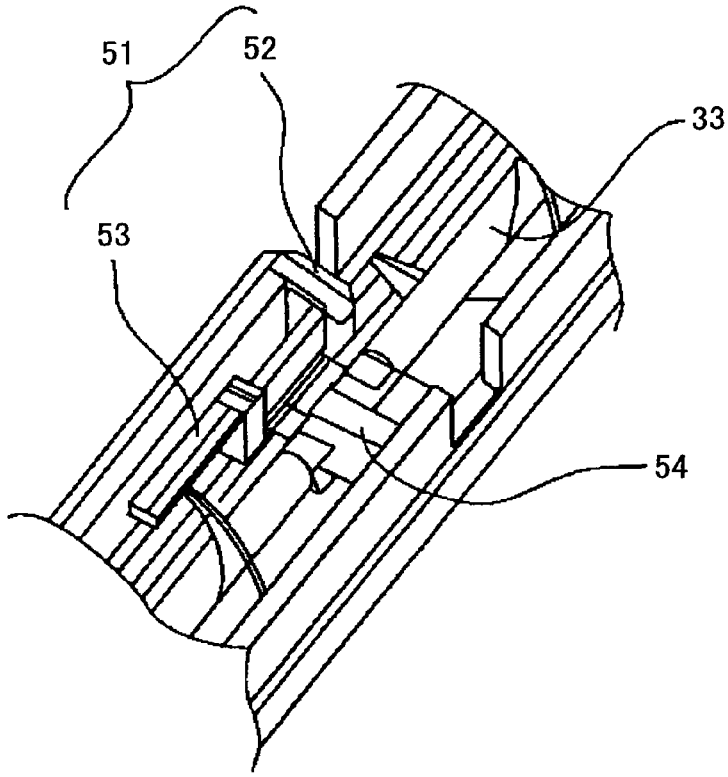
FIG. 5 is a perspective view of major parts illustrating a configuration in the vicinity of an optical sensor of the image developing device according to a first embodiment.

Further, as shown in FIG. 3, the upper tank 34 of the image developing device 3 includes the optical sensor 51, which is a developer amount detection unit that detects a residual amount of the toner inside the image developing device 3. FIG. 5 is a perspective view illustrating a major configuration in the vicinity of the optical sensor. As shown in FIG. 5, in the optical sensor 51, a luminescence sensor (not shown), which is attached to a side portion of the main body, irradiates a light beam. The irradiated light beam is guided to the upper tank 34 by a first optical guide 52, which is attached to the side wall of the image developing device 3 and which is formed of a resin material having a high degree of transparency. Then the light emitted by the luminescence sensor enters a second optical guide 53 through a space inside the upper tank 34 and guided to the exterior of the upper tank 34. After that a light receiving sensor converts an amount of the light into a voltage and detects presence or absence of the light. When detecting the residual amount of the toner, emission of the light is controlled by applying a voltage to the luminescence sensor, and the existence of the toner can be detected by the output from the light receiving sensor. When the toner or a foreign material is attached to a light emitting plane 62 of the first optical guide 52 and an entrance plane 63 of the second optical guide 53, the light for detecting the residual amount of the toner is blocked. Thus, it can be a cause of an erroneous detection. Therefore, it is preferable to incorporate a cleaning mechanism that can remove substances attached to the light emitting plane 62 of the first optical guide 52 and the entrance plane 63 of the second optical guide 53, such that a cleaning member 54, such as a sheet material, is attached to the rotation axis of the upper conveyance member 33 between the light emitting plane 62 of the first optical guide 52 and the entrance plane 63 of the second optical guide 53 and that the cleaning member 54 removes the attached substances during rotation.

Incidentally, in order to properly detect the amount of the toner in the image developing device 3 by using the above described optical sensor 51, it is important to stably form a toner surface in the emission light path from the luminescence sensor. Therefore, in the first embodiment, the toner conveyance speed by the upper conveyance member 33 in the upper tank 34 of the image developing device, in which the toner surface is formed, is set to be greater than the toner conveyance speed by the lower conveyance member 31. The conveyance speeds by the lower conveyance member 31 and the upper conveyance member 33 can be controlled by varying screw pitches, screw diameters, and rotational speeds of the lower conveyance member 31 and the upper conveyance member 33. For example, the toner conveyance speed becomes greater in proportion to the screw pitch. That is because an amount of the toner conveyed per one rotation of the screw becomes larger, as the screw pitch is increased.

When the toner conveyance speed by the upper conveyance member 33 is greater than the toner conveyance speed by the lower conveyance member 31, the toner which collides with the wall surface at the end portion at the downstream most side of the upper tank 34 does not move to the lower tank 32 quickly and tends to accumulate. Thus the toner surface in the upper tank 34 is formed to be slanted such that a height of the toner surface becomes larger along the direction from the upstream side in the toner conveyance direction toward the downstream side. Therefore, even if the liquidity of the toner is low, unevenness of the toner surface is reduced and the toner surface tends to be formed at a proper position corresponding to the residual amount of the toner in the upper tank 34, in comparison to a case in which the conveyance speed by the lower conveyance member 31 and the conveyance speed by the upper conveyance member 33 are the same. Consequently, the optical sensor 51 can detect the toner surface formed at the proper position corresponding to the residual amount of the toner.

Especially, as shown in FIG. 3, it is preferable that the optical sensor 51 be arranged at a position in the downstream side in the developer conveyance direction from the center portion in the longitudinal direction of the upper tank 34. That is because, when the toner tends to accumulate at the vicinity of the optical path of the optical sensor 51, namely, at the vicinity of the detection unit of the optical sensor 51, the toner surface can be formed at the proper position corresponding to the residual amount of the toner in the vicinity of the detection unit of the optical sensor 51. Thus this configuration is preferable. Further, when the toner tends to accumulate at the vicinity of the detection unit of the optical sensor 51, it is easier to perform a cleaning operation using the cleaning member 54.

As described above, in the first embodiment, the developer conveyance speed in the upper tank 34 is set to be greater than the developer conveyance speed in the lower tank 32, so that the toner surface is formed at the proper position corresponding to the residual amount of the toner in the vicinity of the detection unit of the optical sensor 51. According to this configuration, the toner tends to accumulate in the vicinity of the detection unit of the optical sensor 51. That is an important matter for properly detecting the amount of the toner in the image developing device 3 by using the optical sensor 51.

Next, an example according to the first embodiment is concretely explained. First, a production method of the toner used in the example and in a comparative example is explained.

[Synthesis of Polyester 1]

A reaction container having a cooling pipe, an agitator, and a nitrogen inlet tube was charged with 235 parts of bisphenol A ethylene oxide 2-mole adduct, 525 parts of bisphenol A propylene oxide 3-mole adduct, 205 parts of terephthalic acid, 47 parts of adipic acid, and 2 parts of dibutyltin oxide. The resultant mixture was allowed to react under normal pressure at 230 degrees Celsius for 8 hours. Further, the pressure was reduced by an amount within a range from 10 mm Hg to 15 mm Hg and the reaction was continued for 5 hours. Subsequently, 46 parts of trimellitic anhydride were added into the reaction container and the reaction was continued for 2 hours under normal pressure. In this manner, "a polyester 1" was obtained. "The polyester 1" was found to have a number average molecular weight of 2600, a weight average molecular weight of 6900, a glass transition temperature (Tg) of 44 degrees Celsius, and an acid value of 26.

[Synthesis of Prepolymer 1]

A reaction container having a cooling pipe, an agitator, and a nitrogen inlet tube was charged with 682 parts of bisphenol A ethylene oxide 2-mole adduct, 81 parts of bisphenol A propylene oxide 2-mole adduct, 283 parts of terephthalic acid, 22 parts of trimellitic anhydride, and 2 parts of dibutyltin oxide. The resultant mixture was allowed to react under normal pressure at 230 degrees Celsius for 8 hours. Further, the pressure was reduced by an amount within a range from 10 mm Hg to 15 mm Hg and the reaction was continued for 5 hours. In this manner, "an intermediate polyester 1" was obtained. "The intermediate polyester 1" was found to have a number average molecular weight of 2100, a weight average molecular weight of 9500, a Tg of 55 degrees Celsius, an acid value of 0.5 and a hydroxyl value of 49. Subsequently, a reaction container having a cooling pipe, an agitator, and a nitrogen inlet tube was charged with 411 parts of "the intermediate polyester 1," 89 parts of isophorone diisocyanate and 500 parts of ethyl acetate. The resultant mixture was allowed to react at 100 degrees Celsius for 5 hours, and "a prepolymer 1" was obtained. The amount of free isocyanate contained in "the prepolymer 1" was found to be 1.53% by mass.

[Preparation of Masterbatch 1]

First, 40 parts of carbon black (REGAL400R, product of Cabot Corporation), 60 parts of binder resin, which is a polyester resin (RS-801, which is a product of Sanyo Chemical Industries, Ltd., and having an acid value of 10, a weight average molecular weight (Mw) of 20000, and Tg of 64 degrees Celsius), and 30 parts of water were mixed by a Henschel mixer. Then a mixture, in which water is soaked into a pigment agglomerate, was obtained. The mixture was kneaded for 45 minutes with two rollers, whose surface temperature was set to 130 degrees Celsius. Then the resultant mixture was broken into pieces having a size of 1 mm by using a pulverizer. In this manner, "a masterbatch 1" was obtained.

[Production of Pigment/Wax-Dispersed Solution 1 (Oil Phase)]

A container equipped with an agitator and a thermometer was charged with 545 parts of the polyester 1, 181 parts of paraffin wax, 1450 parts of ethyl acetate. The resultant mixture was agitated and heated to 80 degrees Celsius. Then the temperature of the resultant mixture was kept at 80 degrees Celsius for 5 hours. Subsequently, the resultant mixture was cooled to 30 degrees Celsius within one hour. Next, a container was charged with 500 parts of the masterbatch 1, 100 parts of a charge control agent (1), and 100 parts of ethyl acetate. The resultant mixture was mixed for one hour. In this manner, "a raw material solution 1" was obtained. Then 1500 parts of "the raw material solution 1" were moved to another container, and the carbon black and wax were dispersed with a bead mill (Ultra Viscomill, product of IMEX CO. LTD.) under the following conditions: a liquid feed rate of 1 billion kilograms per hour, a disk circumferential velocity of 6 m/s, 0.5 mm-zirconia beads packed to 80% by volume, and 3 passes. Next, 425 parts of the polyester 1 and 230 parts of the polyester 1 were added thereto, and passed once with the bead mill under the above conditions. In this manner "a pigment/wax-dispersed solution 1" was obtained. After that, "the pigment/wax-dispersed solution 1" was adjusted so that the solid content concentration (at 130 degrees Celsius, 30 minutes) of "the pigment/wax-dispersed solution 1" became 50%.

[Aqueous Phase Production Process]

After 970 parts of ion-exchanged water, 40 parts of 25 wt % aqueous dispersion of organic resin fine particles (copolymers of a sodium salt of styrene-methacrylic acid-butyl acrylate-methacrylic acid ethylene oxide adduct sulfate ester), 140 parts of 48.5% aqueous solution of dodecyl diphenyl ether sodium disulphonate (Eleminor MON-7, manufactured by Sanyo Chemical Industries, Ltd.) and 90 parts of ethyl acetate were mixed and stirred, a milky white liquid was obtained. This is referred to as "an aqueous phase 1."

[Emulsification Process]

After 975 parts of "the pigment/wax-dispersed solution 1" and 2.6 parts of isophorone diamine, as an amine, were mixed by a TBk homomixer (a product of Tokushu Kika Kogyo Co., Ltd.) for 1 minute at 5000 rpm, 88 parts of "the prepolymer 1" were added thereto, and the resultant mixture was mixed by the TBk homomixer (product of Tokushu Kika Kogyo Co., Ltd.) for 1 minutes at 5000 rpm. Subsequently, 1200 parts of "the aqueous phase 1" was added thereto, and the resultant mixture was mixed by the TBk homomixer for 20 minutes, while the rotational speed was adjusted between 8000 rpm and 13000 rpm. In this manner, "an emulsified slurry 1" was obtained.

[Solvent Removal Process]

A container equipped with an agitator and a thermometer was charged with "the emulsified slurry 1," and the solvent removal process was performed at 30 degrees Celsius for 8 hours. In this manner, "a dispersion slurry 1" was obtained.

[Washing and Drying Process]

After 100 parts of "the dispersion slurry 1" was filtered under reduced pressure, the processes (1) through (5) described below were performed.

(1) After 100 parts of ion-exchanged water was added to the filtration cake, the resultant mixture was mixed by the TBk homomixer (at 12000 rpm for 10 minutes) and filtered. The color of the filtrate was milky white.

(2) After 900 parts of ion-exchanged water was added to the filtration cake of (1), the resultant mixture was mixed by the TBk homomixer (at 12000 rpm for 30 minutes) while supersonic vibration was applied to it. Then the resultant mixture was filtered. The process was repeated until the electric conductivity of the slurry liquid became less than or equal to 10 μC/cm.

(3) Hydrochloric acid (10%) was added to the slurry liquid of (2) until the pH of the slurry liquid became 4. Then the resultant mixture was mixed by a three-one motor for 30 minutes. After that, the resultant mixture was filtered.

(4) After 100 parts of ion-exchanged water was added to the filtration cake of (3), the resultant mixture was mixed by the TBk homomixer (at 12000 rpm for 10 minutes). Then the resultant mixture was filtered. The process was repeated until the electric conductivity of the slurry liquid became less than or equal to 10 μC/cm. In this manner, "a filtration cake 1" was obtained.

(5) "The filtration cake 1" is dried by an air-circulating drier at 42 degrees Celsius for 48 hours. Then the dried "filtration cake 1" was passed through a sieve with a mesh size of 75 μm. In this manner, a toner parent body was obtained. The toner parent body was found to have an average circularity of 0.974, a volume-average particle diameter (Dv) of 6.3 μm, and a number-average particle diameter (Dp) of 5.3 μm. Further, Dv/Dp was found to have a particle size distribution of 1.19. Subsequently, 1.8 parts of hydrophobic silica was added to 100 parts of the toner parent body, and the resultant mixture was mixed by the Henschel mixer. In this manner the toner of the example was obtained.

Next, toner (1) was produced by performing the following process, in which a lubricant agent was added as an external additive agent. The toner parent body, to which the following process was not applied and the hydrophobic silica was used, is referred to as toner (2). In this example, it is preferable that more than 1 type of inorganic fine particles be used as the external additive agent, which enhances liquidity, electrostatic property, developability, and transferability of the toner particles. It, is preferable that the specific surface area of the inorganic fine particles by the BET method be within a range from 30 $m^2/g$ to 300 $m^2/g$. Further, it is preferable that the primary particle size of the inorganic fine particles is within a range from 10 nm to 50 nm.

[External Additive Agent of Toner (1)]

After 1 part by mass of silicone oil was added to 100 parts by mass of silicon dioxide, the resultant mixture was mixed by a Henschel mixer. Then the resultant mixture was stiffened or wettened at 250 degrees Celsius for two hours. The external additive agent of the toner (1) was prepared by applying a hydrophobic treatment to the resultant mixture.

<Agglomeration Degree Measurement Method>

An agglomeration degree was measured as follows. As a measuring device (not shown), a powder tester produced by Hosokawa Micron Corporation was used. Required accessories were set on a vibrating table in the following order: (i) vibro-shoot, (ii) packing, (iii) space ring, (iv) screens (three types) upper>middle>lower, and (v) pressing bar. These accessories were fixed by knob nuts. Then the vibrating table was operated. The measurement conditions were as follows:

screen opening (upper): 75 μm
screen opening (middle): 45 μm
screen opening (lower): 22 μm
vibration amplitude: 1 mm
sample mass: 2 g
vibrating period: 10 seconds After the measurement in accordance with the above described procedure was performed, the agglomeration degree was obtained by the following calculations.

(a) Calculate (mass (wt %) of the powders remaining on the upper screen)×1.

(b) Calculate (mass (wt o) of the powders remaining on the middle screen)×0.6.

(c) Calculate (mass (wt o) of the powders remaining on the lower screen)×0.2.

The total of the values obtained by the above described procedures (a), (b), and (c) was defined to be the agglomeration degree (%).

Then a color printer (IpsioSPC310, manufactured by Ricoh Company, Ltd.) was modified so that the image developing device 3 (example 1 through example 4, and comparative example 1 through comparative example 3) and the toner supply container 4 can be attached thereto, and the following experiments were performed. The process cartridge (the image developing device 3) was connected to an imaging drive motor, so that the process cartridge was driven by the imaging drive motor. The toner supply container 4 was connected to the driving source of the image developing device 3 through a clutch, so that the toner supply container 4 was driven by the driving source of the image developing device 3. With this configuration, the toner could be supplied by connecting the driving source and the driving gear of the toner supply container 4. As described above, based on the presence or absence of the silica material containing the oil, which was added as the external additive component, two kinds of toner having different types of liquidity (the toner (1) and the toner (2)) were prepared, and used in the experiments.

In the experiments, first, an examination for evaluating the durability of the photosensitive body was performed. In the examination, a running test, in which the running distance of the photosensitive body was 1000 m, was performed, and the variation of the film thickness of the photosensitive body was checked. For the measurement of the film thickness, the Fischer Scope MMS (manufactured by Fischer Instruments K.K.), which is a film thickness measuring device, was used, and determination was made as to whether an amount of wear was less than or equal to 0.5 μm. Subsequently, the toner was supplied to the image developing device 3, and, at the same time, a test was performed with respect to the ability of detecting the amount of the toner remaining in the image developing device 3. The output from the sensor was observed. The sampling frequency was set to be 20 nm, and the sampling was performed for 4 seconds. The output voltage was binarized, and determination was made as to whether the light was transmitted or not. It was determined that the toner was present when the light was blocked during time intervals, in which the total of the time intervals were longer than or equal to 80% of the whole sampling interval. The image developing device 3 had the maximum toner loading capacity of 150 g. The sensor was arranged at a height corresponding to the toner surface that was idealistically formed by 90 g of the toner. Namely, the sensor was arranged at a position, at which the sensor could detect the toner surface that was idealistically formed by 90 g of the toner. With such a configuration, the amount of the toner stored in the image developing device 3 was detected, while the toner was supplied. Here, a detected weight was defined to be the weight of the toner that had been supplied to the image developing device 3 until the time at which the output from the sensor indicated the state where the light was blocked by the toner. For a stable operation, determination was made as to whether the weight of the supplied toner was within the range of 90±30 g.

Example 1

In example 1, the toner (1) was used. A screw member having a pitch of 35 mm was used as the upper conveyance member 33 in the upper tank 34. A screw member having a pitch of 25 mm was used as the lower conveyance member 31 in the lower tank 32. The detecting position by the optical sensor 51 was placed above the first communication port 37 of the partition member 36.

Example 2

The same conditions as the conditions of example 1 were applied to example 2, except that the number of the teeth of the screw rotation gear of the upper conveyance member 33 in the upper tank 34 was increased from 45 to 48 and that the rotational speed of the upper conveyance member 33 was increased.

Example 3

The same conditions as the conditions of example 1 were applied to example 3, except that the detection position by the optical sensor 51 was shifted from the first communication port 37 of the partition member 36 by 20 mm toward the upstream side in the toner conveyance direction.

Example 4

The same conditions as the conditions of example 1 were applied to example 4, except that 2 pitches from the downstream-most side in the toner conveyance direction of the screw blades were modified so that the conveyance direction was reversed.

Comparative Example 1

The same conditions as the conditions of example 1 were applied to comparative example 1, except that the toner (2) was used.

Comparative Example 2

The same conditions as the conditions of example 1 were applied to comparative example 2, except that the screw pitch of the upper conveyance member 33 in the upper tank 34 and the screw pitch of the lower conveyance member 31 in the lower tank 32 were set to 25 mm.

Comparative Example 3

The same conditions as the conditions of example 1 were applied to comparative example 3, except that the number of the teeth of the screw rotation gear of the upper conveyance member 33 in the upper tank 34 was decreased from 45 to 42 and that the rotational speed of the upper conveyance member 33 was decreased.

Table 1 shows the results of the experiments.

TABLE 1

| | Upper conveyance member | Number of teeth of gear | Lower conveyance member | Toner | Accelerated agglomeration degree | Wear of photo-sensitive body | Detected weight | Result |
|---|---|---|---|---|---|---|---|---|
| Example 1 | 35 mm pitch | 45 | 25 mm pitch | (1) | 73.8 | 0.25 μm | 120 | ○ |
| Example 2 | 35 mm pitch | 48 | 25 mm pitch | (1) | 73.8 | 0.25 μm | 110 | ○ |
| Example 3 | 35 mm pitch | 45 | 25 mm pitch | (1) | 73.8 | 0.25 μm | 105 | ○ |
| Example 4 | 35 mm pitch | 45 | 25 mm pitch | (1) | 73.8 | 0.25 μm | 110 | ○ |
| Comparative example 1 | 35 mm pitch | 45 | 25 mm pitch | (2) | 40.3 | 1.1 μm | 110 | x |
| Comparative example 2 | 25 mm pitch | 45 | 25 mm pitch | (1) | 73.8 | 0.25 μm | 135 | x |
| Comparative example 3 | 25 mm pitch | 42 | 25 mm pitch | (1) | 73.8 | 0.25 μm | 140 | x |

The results of table 1 shows that, even if the toner having a low degree of liquidity was used, such as the toner having the accelerated agglomeration degree of greater than or equal to 60%, in the image developing device 3 according to example 1 through example 4, where the conveyance speed of the toner in the lower tank 32 was greater than the conveyance speed of the toner in the upper tank 34, no erroneous detection was found and fine image quality without blurring of an image and clogging of the toner was obtained for a long time. Namely, with the image developing device 3 according to the first embodiment, even if the toner having a low degree of liquidity was used, such as the toner having the accelerated agglomeration degree of greater than or equal to 60%, by stably forming the toner surface in the vicinity of the detection unit of the optical sensor 51 arranged in the upper tank 34, fine image quality without blurring of an image and clogging of the toner was obtained for a long time. Especially, in example 3, where the detection position by the optical sensor 51 was moved to a position, which is in the downstream side from the center portion of the partition member 36 and is in the upstream side from the first communication port 37, the detected amount of the toner remaining in the image developing device 3 was reduced compared to examples 1 and 2. In contrast, in comparative example 1, the toner (2) was used. The lubricant agent as the external additive component was not added to the toner (2). The accelerated agglomeration degree of the toner (2) was small and the toner (2) had fine liquidity. However, the wear amount of the photosensitive body was large and durability was found to not be fine. Further, in comparative examples 2 and 3, where the toner conveyance speed in the lower tank 32 was less than or equal to the toner conveyance speed in the upper tank 34, the toner surface in the vicinity of the optical sensor was unstable, and erroneous detection tended to occur. Therefore, in comparative examples 2 and 3, the operational stability was found to be insufficient.

Further, the oil-containing component was added to the external additive component of the toner used in the first embodiment. In this manner, by adding the oil-containing component, the accelerated agglomeration degree of the toner can be increased.

Second Embodiment

Hereinafter, another embodiment (referred to as the second embodiment) applied to a color printer, which is an image forming device utilizing an electrographic method, is explained. The second embodiment and the above described first embodiment differ in the following points concerning the configurations. In the first embodiment, the developer conveyance speed in the upper tank 34 is set to be greater than the developer conveyance speed in the lower tank 32, so as to form the toner surface at the proper position corresponding to the amount of the toner in the vicinity of the detection unit of the optical sensor 51. Thus the developer tends to accumulate in the vicinity of the detection unit of the optical sensor. On the other hand, in the second embodiment, the developer conveyance speed between the first optical guide 52 and the second optical guide 53 in the upper tank 34, which are the detection unit of the optical sensor 51, is set to be less than the developer conveyance speed at other portions, so that the developer tends to accumulate in the vicinity of the detection unit of the optical sensor 51. Further, in the second embodiment, it is defined that the image developing device 3 includes a cleaning unit for cleaning the light emitting plane 62 of the first optical guide 52 and the entrance plane 63 of the second optical guide 53. Additionally, in the second embodiment, after the light emitting plane 62 and the entrance plane 63 are cleaned by the cleaning unit, an entering amount of the developer to the space between the light emitting plane 62 and the entrance plane 63 is regulated, by reducing the developer conveyance speed between the first optical guide 52 and the second optical guide 53 compared to the developer conveyance speed at other portions. In this manner, the detection accuracy of the optical sensor 51 for detecting the amount of the developer is improved. Since the configurations of other points of the second embodiment are almost the same as that of the first embodiment, explanations of the similar configurations are arbitrary omitted. Further, for the members that are common between the first embodiment and the second embodiment, the same reference numerals are used and explained, provided there is no special requirement.

Figure 6:
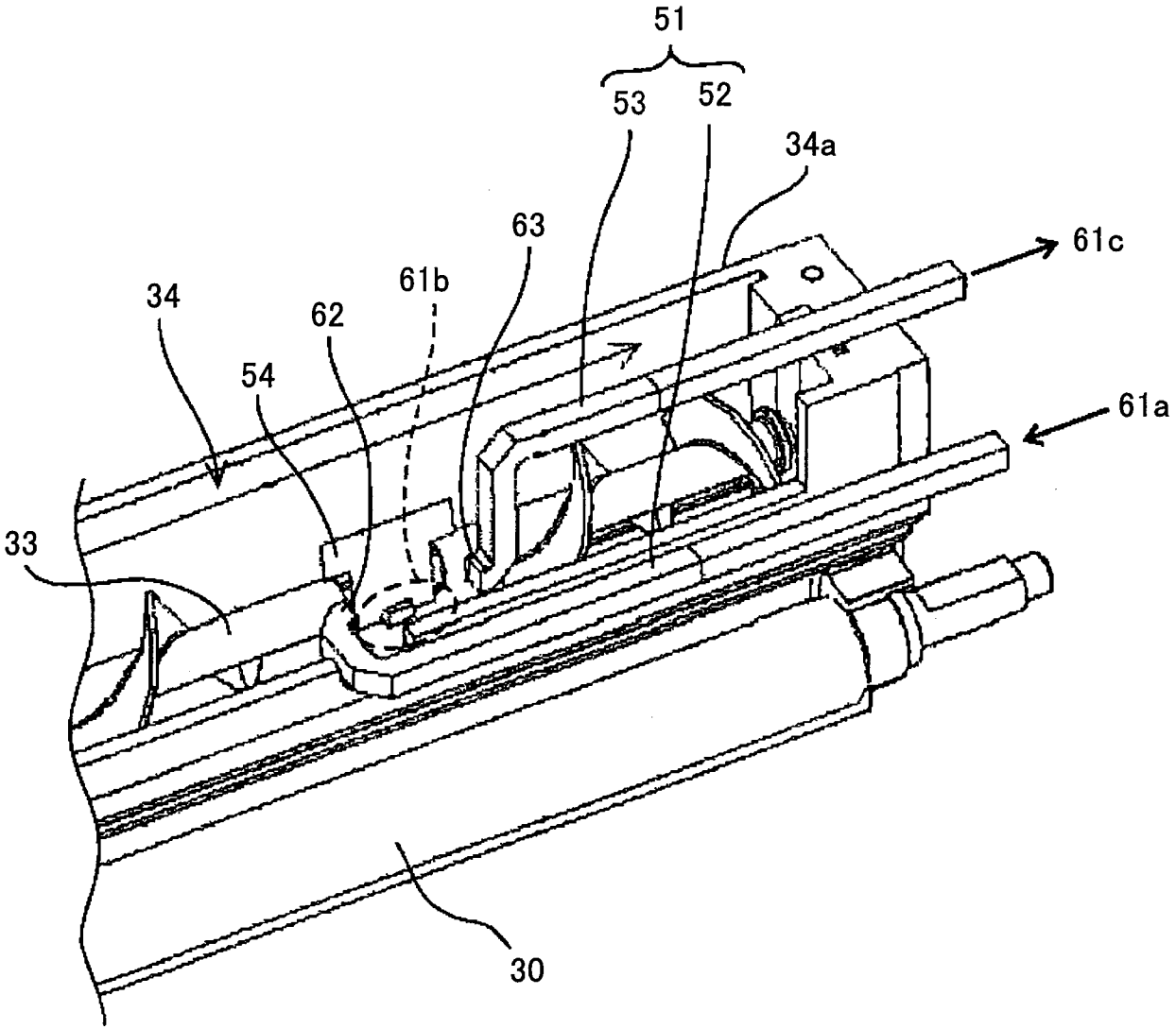
FIG. 6 is a perspective view of major parts illustrating a configuration in the vicinity of an optical sensor of the image developing device according to a second embodiment.

First, a configuration in the vicinity of the optical sensor 51 is explained. The optical sensor 51 is the developer detection unit of the second embodiment. FIG. 6 is a perspective view of major portions that illustrates the configuration in the vicinity of the optical sensor 51 according to the second embodiment. The viewpoint and the direction for the perspective view of FIG. 6 are different from the view point and the direction for the perspective view of FIG. 5, which has been used for the explanation of the first embodiment. FIG. 6 is the perspective view in which the optical sensor 51 arranged at a downstream side in the developer conveyance direction in the upper tank 34 is viewed from a side wall on which an opening for exposing the image developing roller 30 of the image developing device 3 is provided. As shown in FIG. 6, in the second embodiment, the optical sensor 51 similar to that of the first embodiment is provided. In the second embodiment, the optical sensor 51 is a developer amount detection unit for detecting a residual amount of the toner in the image developing device 3.

In the optical sensor 51, a luminescence sensor (not shown) attached to a side wall of the main body of the image forming device irradiates alight beam 61*a*. The irradiated light beam is guided toward inside the upper tank 34 by the first optical guide 52. The first optical guide 52 is attached to the side wall of the image developing device 3. The first optical guide 52 is formed of a resin material having a high degree of transparency. The light beam irradiated from the luminescence sensor enters the second optical guide 53 through a space 61*b* in the upper tank 34, which is shown in the FIG. 6 by a dashed line, and the light beam is guided to the outside of the upper tank 34. After that, the amount of the light can be converted into a voltage by a photodetector (not shown), which is placed at an exit portion of the second optical guide 53. The received light intensity can be recognized by the amplitude of the converted output voltage. With such a configuration, the presence or absence of the light passing through the space 61*b* can be detected. Namely, detecting the residual amount of the toner means to control an amount of luminescence by varying an electric current applied to the luminescence sensor, and to detect the presence of the toner in the space 61*b* by the output from the photodetector.

For detecting the residual amount of the toner, it is important that the light emitting plane 62 of the first optical guide 52 and the entrance plane 63 of the second optical guide 53 are always kept clean, so as to ensure that the light path can only be blocked by the presence of the toner, and so that the presence or absence of the toner in the space 61*b* is accurately recognized. For example, when the toner or a foreign material is attached to the light emitting plane 62 or the entrance plane 63, since the light may be blocked even if the toner is absent in the space 61*b*, the output voltage is decreased and it can be a cause of an erroneous detection. Therefore, in the second embodiment, a cleaning member 54, such as a sheet material, is attached to a range of the rotation axis of the upper conveyance member 3 corresponding to the detection unit of the optical sensor 51. Namely, in the second embodiment, a cleaning unit is arranged at the range corresponding to the detection unit of the optical sensor 51. The cleaning unit can remove substances attached to the light emitting plane 62 and the entrance plane 63 by its rotation. In the second embodiment, the configuration such that the cleaning member 54 is directly attached to the upper conveyance member 33 and the cleaning of the light emitting plane 62 and the entrance plane 63 is performed in synchronization with the rotational motion for circulating the toner is indicated, so as to reduce the number of components to facilitate the cost reduction. However, the second embodiment is not limited to this configuration. For example, a cleaning unit may be provided by introducing another rotation axis.

When the image developing device operates for forming an image, the upper conveyance member 33 is rotated by a drive transmission unit (not shown) so as to circulate the toner. When the upper conveyance member 33 rotates, the cleaning member 54 attached to the rotation axis of the upper conveyance member 33 rotates accordingly. Here, the cleaning member 54 has a substantially T-shape. The portion of the cleaning member 54 corresponding to the vertical line portion of the T-shape is attached to the peripheral surface of the rotation axis of the upper conveyance member 33, so that the portion of the cleaning member 54 is perpendicular to the shaft center. When the upper conveyance member 33 rotates, edges of the portion of the cleaning member 54 corresponding to the horizontal line portion of the T-shape contact the light emitting plane 62 and the entrance plane 63, respectively, and the toner and the substances attached to the light emitting plane 62 and the entrance plane 63 are removed. With such a configuration, the optical path in the space 61*b* can be secured.

Figure 7A:
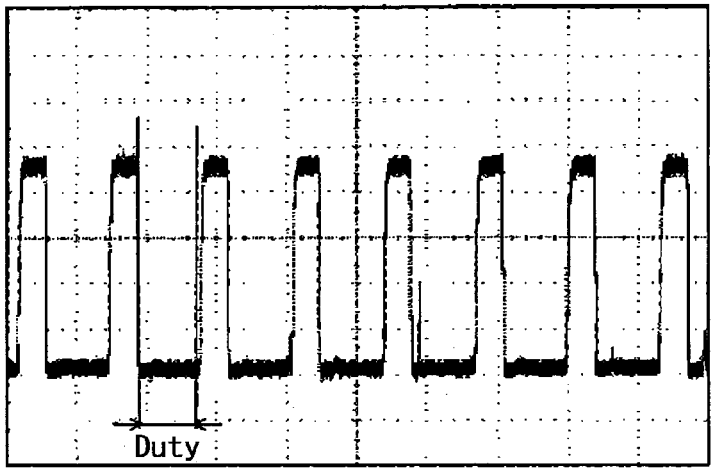
FIGS. 7A, 7B, and 7C are schematic diagrams of detected output waveforms, in which an output voltage of an optical sensor during reception of light is plotted in every constant interval.
Figure 7B:
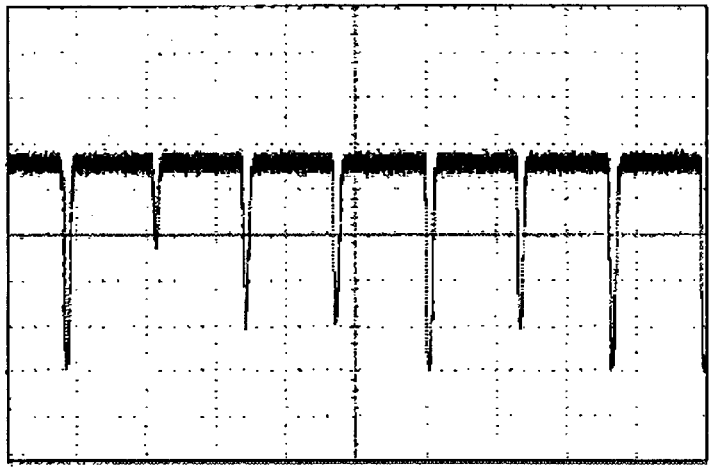
Figure 7C:
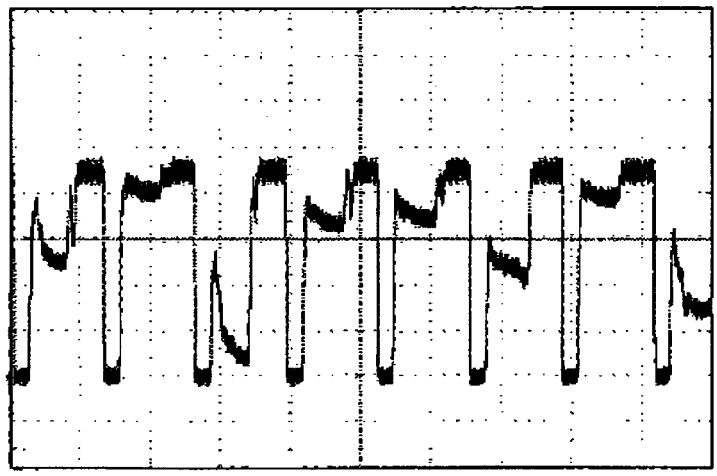

In the printer according to the second embodiment, detection of the developer by the optical sensor 51, which is the developer detection unit, is performed as follows. Here, FIGS. 7A, 7B, and 7C are schematic diagrams of detection output waveforms in which output voltages of the optical sensor 51 during the reception of the light are plotted at regular intervals. When the light passes through the detection unit of the optical sensor 51, namely, when the light passes through the optical path in the space 61*b*, the electric current is blocked, and the output voltage is shifted to 0 V (lower side in the graphs). When there is no toner in the space 61*b*, namely, when the detection unit of the optical sensor 51 is supposed to detect that there is no toner in the detection unit, since there are some time intervals, within which the light passes through the optical path, the output voltage has a characteristic such that 0 V and the input voltage are periodically alternated, as shown in FIG. 7A. On the other hand, when the toner exists in the space 61*b*, namely, when the detection unit of the optical sensor 51 is supposed to detect that the toner exists in the detection unit, the output voltage is almost equivalent to the input voltage, as shown in FIG. 7B. In the second embodiment, the remaining amount of the toner is detected by a ratio occupied by the waveform corresponding to the state, where the light passes through the optical path, over the output waveform (hereinafter, this ratio is referred to as the duty).

With such a configuration, for example, when the cleaning is insufficient and the toner is scattered over the light emitting plane 62 or the entrance plane 63, the output waveform becomes the waveform shown in FIG. 7C. In such a case, even if there is no toner in the space 61*b*, the light can be blocked, and the ratio corresponding to the state, where the light passes through the optical path, may not be detected accurately.

Figure 8:
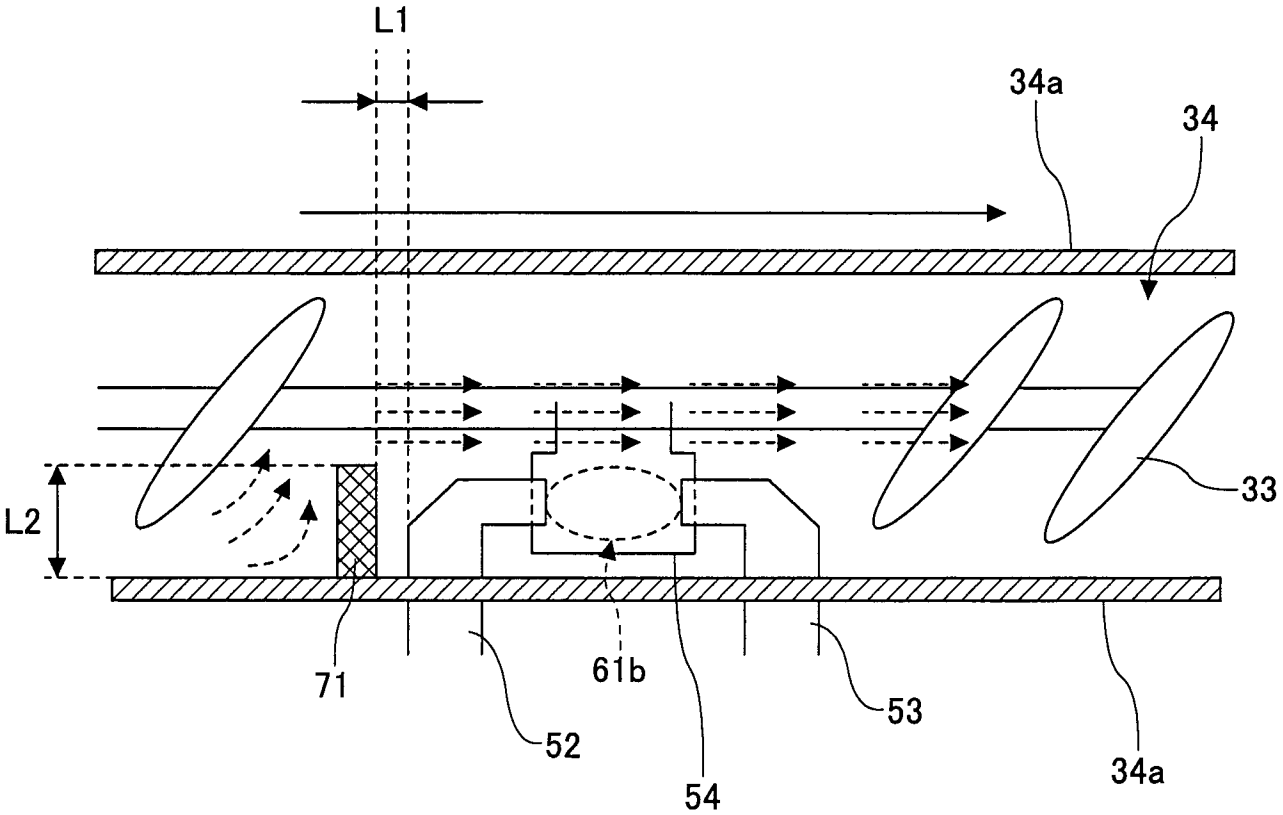
FIG. 8 is a diagram illustrating a flow of toner when a rib is arranged at an upstream side of a detection unit of an upper tank of the image developing device according to the second embodiment.
Figure 9:
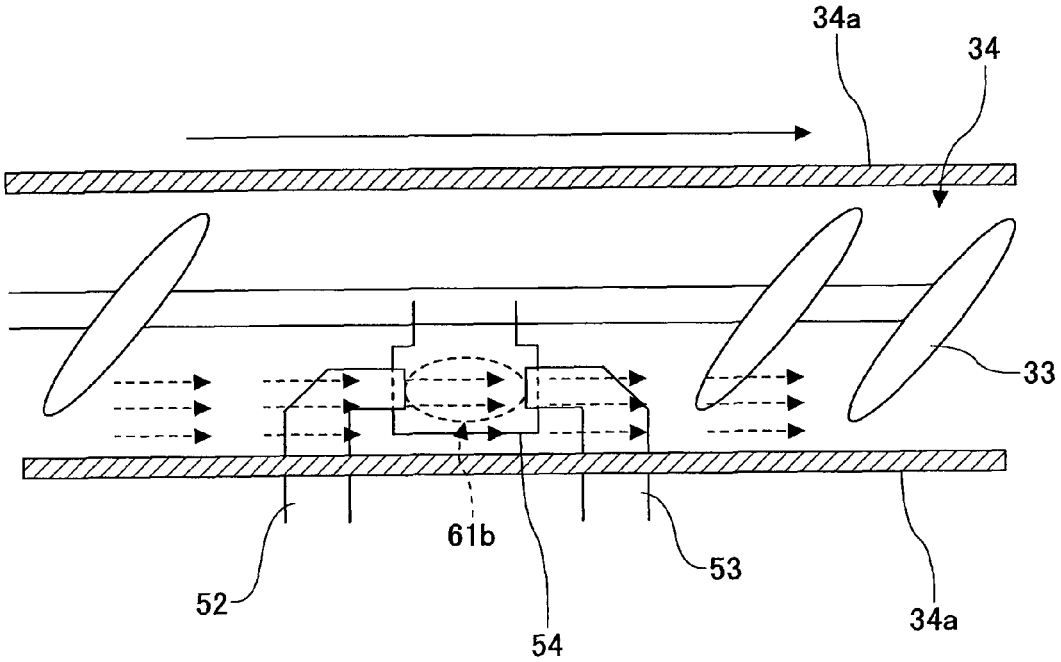
FIG. 9 is a diagram illustrating a flow of toner when a rib is not arranged at an upstream side of a detection unit of an upper tank of an image developing device.

Next, the flow of the toner in the vicinity of the detection unit in the upper tank 34 of the image developing device 3 is explained by using figures. FIG. 8 is a diagram illustrating the flow of the toner when an upstream rib 71 is arranged at an upstream side of the detection unit in the upper tank 34 of the image developing device 3 according to the second embodiment. Further, FIG. 9 is a diagram illustrating the flow of the toner when no rib is provided in the upstream area of the detection unit in the upper tank 34 of the image developing device 3. In the second embodiment, when the remaining amount of the toner is being detected, the amount of the toner in the space 61*b* is recognized while the toner is circulated as described above and the light emitting plane 62 and the entrance plane 63 are cleaned by the rotation of the cleaning member 54 attached to the upper conveyance member 33, which is the second conveyance member. Here, the flow of the toner is changed in the upstream area of the detection unit mainly by the upstream rib 71 that regulates the flow of the toner, so that the amount of the toner enters the detection unit of the optical sensor 51 is reduced. The upstream rib 71 is a blocking member attached to a side wall 34*a* in the upper tank 34, where the upper tank 34 is a second conveyance path in the image developing device 3. Further, in the vicinity of the detection unit of the optical sensor 51, the blade of the screw is not formed around the rotation axis of the upper conveyance member 33. Thus the toner conveyance speed in the area where the blade is not formed is smaller than the toner conveyance speed in other areas. Therefore, the toner conveyance speed at the portion in the downstream side in the developer conveyance direction from the upstream rib 71, where the blade is not formed, is smaller than the toner conveyance speed in other portions. Thus the toner tends to accumulate at the upstream side in the developer conveyance direction from the upstream rib 71. Namely, the toner tends to accumulate in the vicinity of the detection unit of the optical sensor 51. Here, the optical sensor 51 is the developer amount detection unit. On the other hand, when the upstream rib 71 is not arranged, as shown in FIG. 9, namely, when the upstream rib 71 is not attached to the side wall 34*a* in the upper tank 34, since the toner moves in the whole area along with the circulation direction of the toner, the toner always enters the space 61*b* even when the remaining amount of the toner is being detected by the optical sensor 51.

Figure 10A:
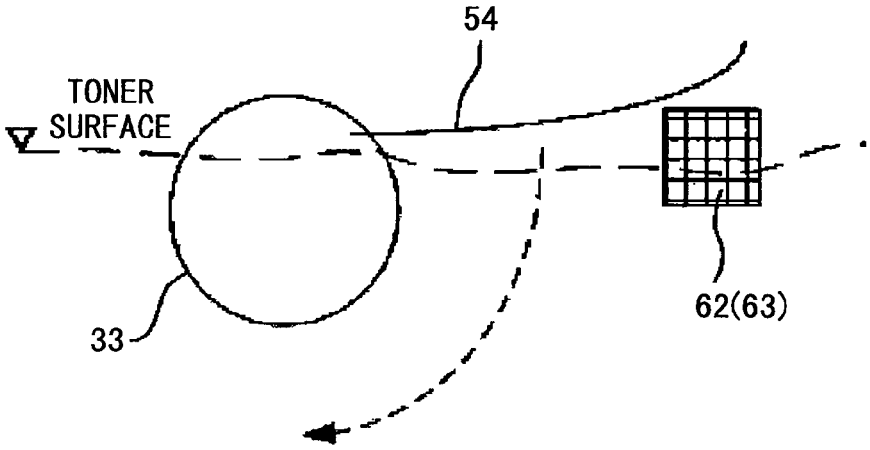
FIGS. 10A and 10B are diagrams illustrating movement of the toner in a cross section perpendicular to a rotation axis of an upper conveyance member.
Figure 10B:
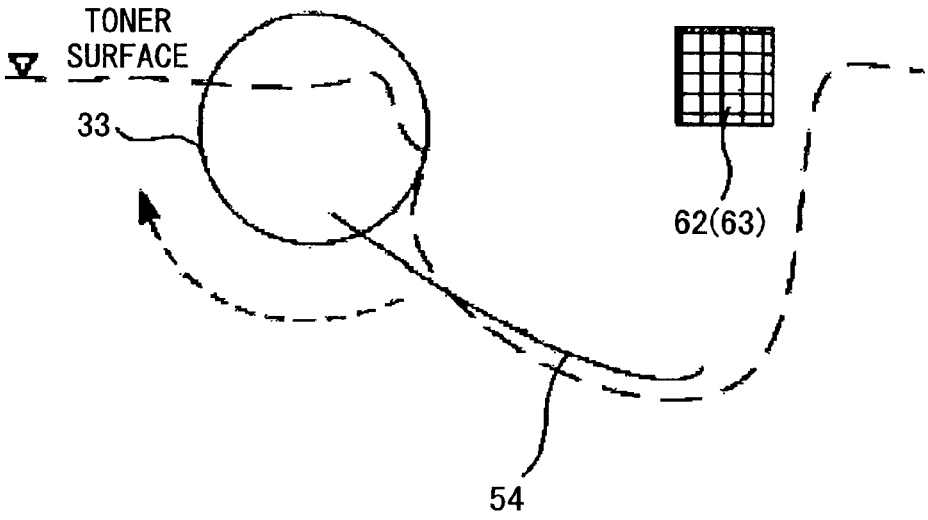

Here, the movement of the toner in the cross section perpendicular to the rotation axis of the upper conveyance member 33 at the detection unit of the optical sensor 51 of the image developing device 3 is explained by using FIGS. 10A and 10B. FIGS. 10A and 10B are diagrams illustrating the movement of the toner in the cross section perpendicular to the rotation axis of the upper conveyance member 33. FIG. 10A shows the state of the toner immediately prior to the light emitting plane 62 of the optical sensor 51 being cleaned by the cleaning member 54. FIG. 10B shows the state of the toner after the light emitting plane 62 of the optical sensor 51 is cleaned by the cleaning member 54. Here, the similar states can be observed at the side of the entrance plane 63 of the optical sensor 51. In accordance with the clockwise rotation of the cleaning member 54 in FIGS. 10A and 10B, the toner in the vicinity of the cleaning member 54 is moved from the state where the toner covers a portion of the light emitting plane 62, as shown in FIG. 10A, to the state shown in FIG. 10B along with the movement of the cleaning member 54. Therefore a cavity is created in the space 61*b* of the detection unit. During the time within which the cavity exists, the time for receiving the light emitted from the light source is ensured.

However, when the circular type image developing device 3 has the configuration shown in FIG. 9, there exists a circulation flow of the toner in the direction perpendicular to the paper surface in FIG. 10B. Therefore, the toner enters the optical path secured by the formation of the cavity, or the light is blocked by the scattered toner. Consequently, the detection accuracy is significantly degraded as shown in FIG. 7B. On the other hand, with the configuration according to the second embodiment shown in FIG. 8, the circulation of the toner at the detection unit can be significantly avoided. Therefore, a stable waveform as shown in FIG. 7A can be obtained by a simple configuration, and the detection accuracy can be significantly improved.

It has been found by experiments that the detection accuracy varies depending on a position and a height of the upstream rib 71 placed at the upstream side in the developer conveyance direction of the detection unit of the optical sensor 51. Next, an example of the evaluation experiments performed for evaluating the configuration of the second embodiment are explained. The image developing unit (the image developing device 3) was charged with 65 g of the toner, 75 g of the toner, 85 g of the toner, and 95 g of the toner, corresponding to the conditions described below. As described above, for each condition, the output waveform was obtained three times, and evaluated based on the duty. Further, as the image developing unit, the same unit was used. By outputting the whole solid images, it was found that the image was blurred due to a shortage in the amount of the toner, when the amount of the toner was 65 g. Therefore, it was evaluated whether the detection unit can stably detect the amount of the toner greater than or equal to 75 g.

Figure 11A:
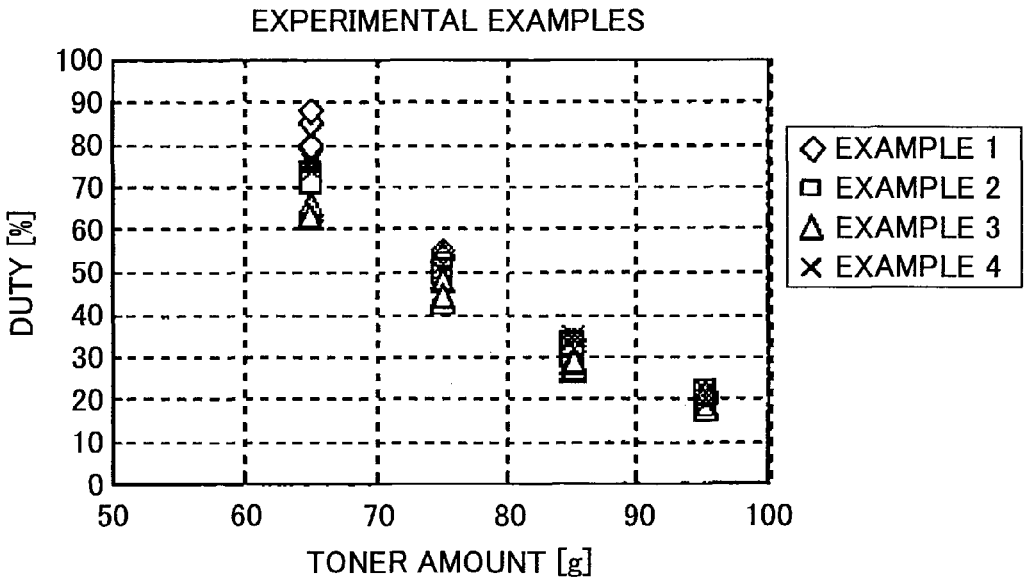
FIGS. 11A and 11B are graphs in which results of evaluation experiments of the second embodiment are plotted.
Figure 11B:
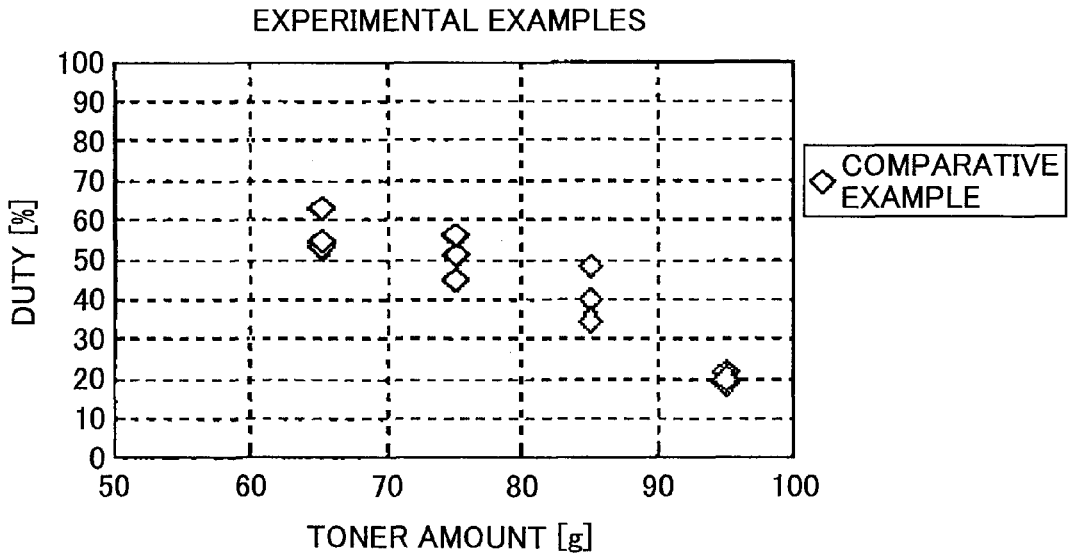

Table 2 shows the conditions corresponding to the cases, where the height of the upstream rib 71, the distance L1 between the upstream rib 71 and the end face of the prism in the upstream side in the developer conveyance direction of the first optical guide 52, and the length L2 of the upstream rib 71 from the inner wall of the side wall 34*a* are varied. Further, FIGS. 11A and 11B are graphs in which the results of the evaluation experiments of the second embodiment are plotted. The results of experiments 1 through 3 are plotted in FIG. 11A. The result of comparative example 1 is plotted in FIG. 11B.

TABLE 2

| No. of experiment | Rib | Position (L1) | Distance from wall surface (L2) | Height of rib | Remarks |
|---|---|---|---|---|---|
| Example 1 | Yes | 5 mm | Less than R (*) | Detection surface + 5 mm | Height of the rib was changed. |
| Example 2 | Yes | 5 mm | Less than R | Detection surface ± 0 mm | Height of the rib was changed. |
| Example 3 | Yes | 5 mm | Less than R | Detection surface − 5 mm | Height of the rib was changed. |
| Example 4 | Yes | 0 mm | Less than R | Detection surface ± 0 mm | Position of the rib was changed. |
| Comparative example 1 | No | — | — | — | Without the rib. |
| Comparative example 2 | Yes | 5 mm | Greater than R | Detection surface ± 0 mm | Clogging of the toner due to insufficient circulation. |

(*) R is the distance between the wall surface and the center axis of the rotation.

From the results indicated in FIG. 11A, it was found that in experiments 1 through 3, in which the configuration of the second embodiment was applied, the duty of the reception light waveform varied almost in proportion to the charged amount of the toner. Namely, the amount of the toner in the image developing unit was stably detected by using the duty of the reception light waveform. Therefore, the amount of the toner in the image developing unit can be stabilized, by monitoring the amount of the toner in the image developing unit, namely, the residual amount of the toner through the duty of the reception light waveform and by controlling the toner charging operation. In this manner, by stabilizing the amount of the toner in the image developing unit, blurring of an image due to a shortage of the toner and scattering of the toner due to an excessive charging amount can be prevented.

On the other hand, the result shown in FIG. 11B indicates that, in comparative example 1, since the error in the duty of the reception light waveform was large, an erroneous detection was highly possible and the amount of the toner in the image developing unit might not be stably controlled. For example, for the duty of 50%, the amount of the toner was varied in the range from 65 g to 85 g. Further, with the condition of comparative example 2 indicated in table 2, as it is described in the remarks column, the upper conveyance member 33 was clogged with the toner due to insufficient circulation of the toner. Therefore, only the result of comparative example 1 is plotted in FIG. 11B.

Figure 12:
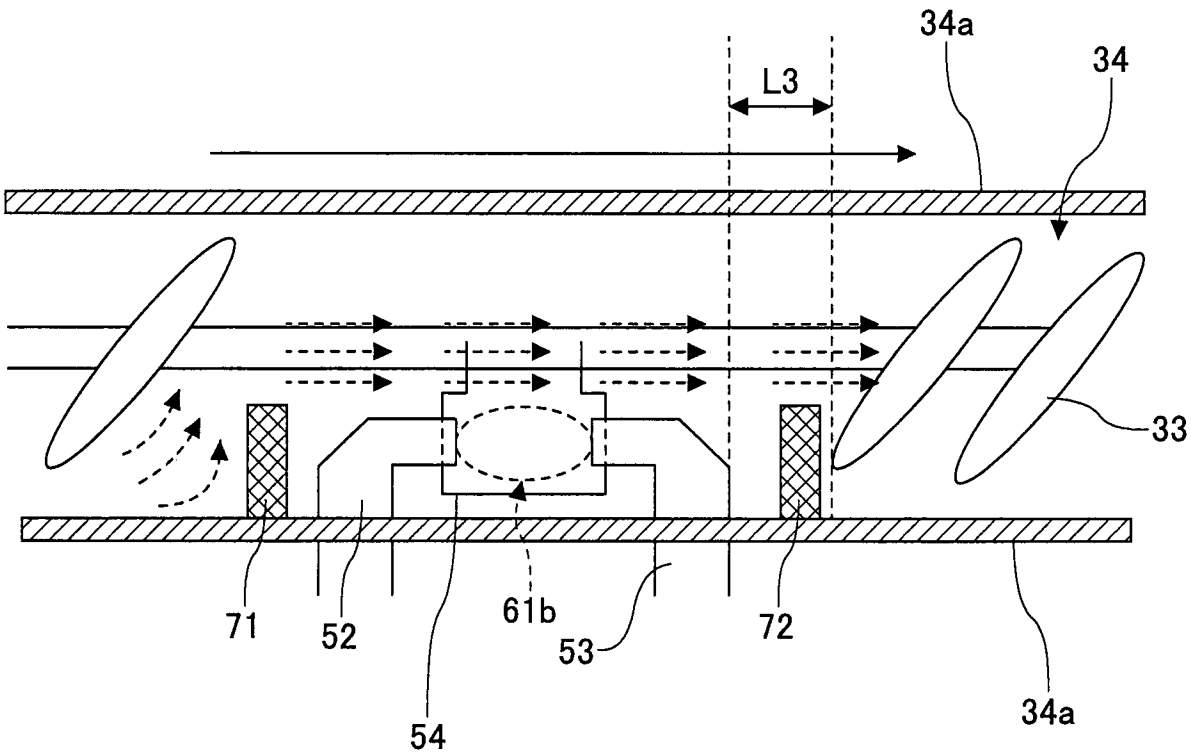
FIG. 12 is a diagram illustrating movement of the toner when ribs are provided at an upstream side and a downstream side of the detection unit of the upper tank of the image developing device according to the second embodiment.

As described above, with the configuration of the second embodiment, it is important to set, during detection of the residual amount, the circulation speed of the toner at the detection unit of the optical sensor 51 to be smaller than the speed of the toner at other portions. Here, FIG. 12 is a diagram illustrating the flow of the toner, when ribs are arranged at an upstream side and at a downstream side of the detection unit in the upper tank 34 of the image developing device 3 according to the second embodiment. As shown in FIG. 12, it is preferable to set the circulation speed of the toner at the detection unit of the optical sensor 51 to be much smaller than the circulation speed of the toner at other portions by providing a downstream rib 72 at the downstream side of the detection unit of the optical sensor 51.

When the upstream rib 71 is only arranged at the upstream side in the developer conveyance direction of the detection unit of the optical sensor 51, the flow of the toner is spread at the detection unit. Thus, strictly, the toner enters the space 61*b* of the detection unit. Therefore, by providing the similar downstream rib 72 at the downstream side in the developer conveyance direction, the flow of the toner at the detection unit of the optical sensor can be blocked, and the detection accuracy can be further improved. Reducing the liquidity of the toner at the detection unit results in reduction of the circulating speed (moving speed of the toner) at the detection unit and, ultimately, results in reduction of circularity of the toner in the whole of the image developing device 3. Therefore, it is preferable that the area, at which the circulating speed is reduced, be set to be as small as possible.

Therefore, at the downstream side of the detection unit, it is preferable that the screw of the upper conveyance member 33 be as close as possible to the second optical guide 53. When the distance between the screw of the upper conveyance member 33 at the downstream side of the detection unit and the end surface of the second optical guide 53 at the downstream side in the toner conveyance direction is less than or equal to 10 mm, preferably less than or equal to 5 mm, the effect of improving the detection accuracy while reducing the area where the circulating speed is reduced becomes higher. Reducing the toner conveyance speed at the detection unit conversely results in forming an area, in which the toner stays, in the image developing device. When an area, in which toner stays, is formed in the circulation of the toner, the toner may not be uniformly conveyed in the longitudinal direction, due to insufficient circulation of the toner. Therefore, an image defect tends to occur, due to insufficient supply of the toner to the image developing roller 30, which is the developer supporting body.

In the first place, when the toner having a low degree of liquidity is used, the effect of improving the detection accuracy while reducing the area where the circulating speed is reduced is high. Here, as described above, when the accelerated agglomeration degree is utilized as an index of the liquidity, it is preferable to use the toner having the accelerated agglomeration degree of 60% or higher. However, when the degree of liquidity is too low, the circulation of the toner in the image developing device may become too slow and the toner may not be sufficiently supplied, so that an image defect tends to occur. Therefore, it is preferable that the accelerated agglomeration degree be less than or equal to 95%.

As described above, in the image developing device 3 according to the first embodiment and the second embodiment, since the toner tends to accumulate in the vicinity of the detection unit of the optical sensor 51 placed in the upper tank 34, the developer surface in the upper tank 34 is formed to be slanted so that the height of the developer surface is increased along the direction from the upstream side portion in the developer conveyance direction toward the detection unit of the developer amount detection unit. Therefore, even if a developer having a low fluidity is utilized so as to respond to a longer life-span, an amount of the developer within the device can be more properly detected. Consequently, an image developing device, a process cartridge which utilizes the image developing device, and an image forming device which utilizes the image developing device can be provided such that blurring of an image and clogging of the toner due to an erroneous detection are prevented, and with which high image quality can be maintained for a long time. Further, the required amount of the developer may be small compared to the case in which the developer reservoir is provided at the upper portion of the extending portion of the second conveyance path, and the developer amount is detected at the developer reservoir. Thus the cost reduction and the downsizing of the device can be facilitated. Further, in the image developing device 3 according to the first embodiment, the toner conveyance speed of the upper conveyance member 33 is greater than the toner conveyance speed of the lower conveyance member 31. Therefore, even if a developer having a low fluidity is utilized so as to respond to a longer life-span, the optical sensor arranged in the upper tank 34 can detect the toner surface formed at a proper position. Thus blurring of an image and clogging of the toner due to an erroneous detection can be prevented. Further, the required amount of the developer may be small compared to the case in which the developer reservoir is provided at the upper portion of the extending portion of the second conveyance path, and the developer amount is detected at the developer reservoir. Thus the cost reduction and the downsizing of the device can be facilitated. Further, in the image developing device 3 according to the first embodiment, since the screw pitch of the upper conveyance member 33 is greater than the screw pitch of the lower conveyance member 31, the toner conveyance speed by the upper conveyance member 33 is greater than the toner conveyance speed by the lower conveyance member 31. With this configuration, the toner surface is formed at a proper position corresponding to the residual amount of the toner in the upper tank 34. Further, in the image developing device 3 according to the first embodiment, since the rotational speed of the upper conveyance member 33 is greater than the rotational speed of the lower conveyance member 31, the toner conveyance speed by the upper conveyance member 33 is greater than the toner conveyance speed by the lower conveyance member 31. With this configuration, the toner surface is formed at a proper position corresponding to the residual amount of the toner in the upper tank 34. With this configuration, the toner is prevented from being clogged at the end portions of the lower tank 32 and the upper tank 34. Further, in the image developing device 3 according to the second embodiment, in the residual amount detection system, in which the light emitting plane 62 and the entrance plane 63 of the optical sensor 51 are cleaned and the light transmission time for the detection light irradiated from the light source is secured, the developer conveyance speed in the vicinity of the detection unit of the optical sensor 51 is less than the developer conveyance speed at other portions. In this manner, by reducing the circulation speed of the toner in the vicinity of the detection unit, the toner may be prevented from entering the area in the vicinity of the detection unit, after the toner in the vicinity of the detection unit has been removed by the cleaning member 54. As a consequence, a stable detection output result can be obtained with respect to the residual amount of the toner. Further, in the image developing device 3 according to the second embodiment, the driving force of the toner is reduced by removing the blade of the upper conveyance member 33 at the portion of the detecting unit of the optical sensor 51 in the upper tank 34. In this manner, by reducing the driving force of the toner, the toner conveyance speed at the detecting portion is reduced, and the toner may be prevented from entering the area in the vicinity of the detection unit, after the toner in the vicinity of the detection unit has been removed by the cleaning member 54. As a consequence, a stable detection output result can be obtained with respect to the residual amount of the toner. Further, in the image developing device 3 according to the second embodiment, the blocking member that regulates the flow of the toner is provided at the upstream side in the toner conveyance direction of the detection unit of the optical sensor 51. In this manner, the circulation speed of the toner at the detection portion may be further reduced by providing the blocking member. Therefore, the toner may be prevented from entering the area in the vicinity of the detection unit, which is caused by the circulation of the toner, after the toner in the vicinity of the detection unit has been removed by the cleaning member 54. As a consequence, a stable detection output result can be obtained with respect to the residual amount of the toner. Further, in the image developing device 3 according to the second embodiment, the blocking member that regulates the flow of the toner arranged at the upstream side in the toner conveyance direction of the detection unit of the optical sensor 51 is the upstream rib 71 attached to the side wall 34*a* of the upper tank 34. In this manner, when the blocking member is integrated with the chassis of the image developing device 3, an additional component may not be required, and a stable detection of the residual amount of the toner can be realized by a less expensive configuration. Further, in the image developing device 3 according to the second embodiment, the height of the upstream rib 71 is greater than or equal to the height of the first optical guide 52. In this manner, by setting the height of the upstream rib 71 to be greater than the height of the detection unit, the toner is prevented from entering the detection unit from the upper portion. Thus a stable detection of the toner residual amount is possible. Further, in the image developing device 3 according to the second embodiment, the upstream rib 71 is placed within 10 mm from the first optical guide 52 in the upstream direction in the toner conveyance direction. By placing the upstream rib 71 in the vicinity of the optical guide 52 in the upstream side in the toner conveyance direction, the toner is prevented from entering the detection unit, when the toner circulates and passes through the upstream rib 71. Thus a stable detection of the toner residual amount is possible. Further, in the image developing device 3 according to the second embodiment, the upstream rib 71 is placed closer to the detection unit of the optical sensor 51 than the rotation axis of the upper conveyance member 33. The upstream rib 71 prevents the toner from entering the detection unit by reducing the circulation speed of the toner only in the vicinity of the detection unit. Thus a stable detection of the toner residual amount is possible. Further, in the image developing device 3 according to the second embodiment, the downstream rib 72 is placed in the downstream side in the toner conveyance direction of the detection unit of the optical sensor 51. The downstream rib 72 reduces the toner circulation speed at the detection unit of the optical sensor 51. Thus a stable detection of the toner residual amount is possible. Further, in the image developing device 3 according to the second embodiment, the second blocking member, which is attached in the downstream side in the toner conveyance direction of the detection unit of the optical sensor 51, that regulates the flow of the toner is the downstream rib 72 attached to the side wall 34*a* in the upper tank 34. In this manner, by integrating the second blocking member with the chassis of the image developing device 3, additional components are not required and a stable detection of the toner residual amount becomes possible by a less expensive configuration. Further, in the image developing device 3 according to the second embodiment, the distance between the end surface in the downstream side in the toner conveyance direction of the second optical guide 53 and the end surface of the screw blade of the upper conveyance member 33 is less than or equal to 10 mm. By arranging the screw blade of the upper conveyance member 33 in this manner, after passing the detection unit of the optical sensor 51, the circulation speed of the toner can be quickly restored to the circulation speed at portions other than the portion of the detection unit. Therefore, in sufficient circulation of the toner caused by the toner accumulated at the detection unit of the optical sensor 51, in sufficient supply of the toner due to insufficient circulation of the toner, and defects on the image can be prevented, and a stable operation is realized and degradation of the image is prevented. Further, in the image developing device 3 according to the second embodiment, the distance between the end surface of the second optical guide 53 in the downstream side in the toner conveyance direction and the end surface of the screw blade of the upper conveyance member 33 is less than or equal to 10 mm. In this manner, since the screw of the upper conveyance member 33 is placed as close as possible to the second optical guide 53, after passing the detection unit of the optical sensor 51, the circulation speed of the toner is quickly restored to the circulation speed at portions other than the portion of the detection unit. Therefore, insufficient circulation of the toner caused by the toner accumulated at the detection unit of the optical sensor 51, insufficient supply of the toner due to insufficient circulation of the toner, and defects on the image are prevented, and a stable operation is realized and degradation of the image is prevented. Further, in the image developing devices 3 according to the first embodiment and the second embodiment, even when the toner with a low liquidity degree, such as the toner having the accelerated agglomeration degree in the range of greater than or equal to 60% and less than or equal to 95%, is utilized, in response to the longer life-span, the toner surface is stably formed in the vicinity of the optical sensor 51 arranged in the upper tank 34. Further, in the image developing devices 3 according to the first embodiment and the second embodiment, the accelerated agglomeration degree of the toner can be enlarged by adding the oil-containing component to the external additive component of the toner. Further, since the process cartridges and the printers according to the first embodiment and the second embodiment include the above described image developing devices 3, the cost reduction is enabled, the life-span can be lengthened, downsizing is enabled, and the stability of the operation can be improved.

The present invention is not limited to the specifically disclosed embodiments, and variations and modifications may be made without departing from the scope of the present invention.

The present application is based on Japanese Priority Applications No. 2011-055969 filed on Mar. 14, 2011, and No. 2011-243029 filed on Nov. 7, 2011, the entire contents of which are hereby incorporated herein by reference.

The invention claimed is:

1. An image developing device comprising:

a developer supporting body configured to support a developer and configured to convey the developer to a portion facing a latent image supporting body;

a first conveyance path in which a first conveyance member is arranged, the first conveyance member being configured to convey the developer along an axis line direction of the developer supporting body;

a second conveyance path in which a second conveyance member is arranged, the second conveyance path being configured to convey the developer in a direction opposite to the developer conveyance direction by the first conveyance member, the second conveyance member being arranged above the first conveyance path; and a partition member configured to partition the first conveyance path and the second conveyance path and that has a first communication port and a second communication port, the first conveyance path and the second conveyance path being configured to communicate with each other at a first end portion and a second end portion in the axis line direction through the first communication port and the second communication port, wherein the image developing device includes a developer amount detection unit that includes an optical detection unit arranged in the second conveyance path and configured to optically detect an amount of the developer in the image developing device, and wherein a second developer conveyance speed by the second conveyance member is greater than a first developer conveyance speed by the first conveyance member so that the developer is caused to accumulate in the vicinity of the developer amount detection unit of the image developing device.

2. The image developing device according to claim 1, wherein the first conveyance member is a first screw and the second conveyance member is a second screw, wherein in each of the first screw and the second screw, blades are attached to a rotation axis, and wherein a second screw pitch of the second conveyance member is greater than the first screw pitch of the first conveyance member.

3. The image developing device according to claim 1, wherein a second rotation speed of the second conveyance member is greater than a first rotation speed of the first conveyance member.

4. The image developing device according to claim 1, wherein at least one of the first conveyance member and the second conveyance member includes a reverse conveyance unit, the reverse conveyance unit being formed at a downstream end portion in the developer conveyance direction and configured to convey the developer in a direction opposite to the developer conveyance direction.

5. The image developing device according to claim 1, wherein the developer amount detection unit includes a first optical guide member configured to guide light output from the developer amount detection unit to the optical detection unit placed in the second conveyance path; and a second optical guide member configured to guide the light from the optical detection unit to an outside of the second conveyance path through a space in the second conveyance path, wherein a light emitting plane of the first optical guide member and an entrance plane of the second optical guide member are periodically cleaned by a sliding operation of a sheet material attached to a rotation axis of the second conveyance member, wherein the light guided by the first guide member is emitted from the light emitting plane of the first optical guide, and the light emitted from the light emitting plane enters the entrance plane of the second optical guide member, and wherein a developer conveyance speed at a portion between the first optical guide member and the second optical guide member is less than a developer conveyance speed at a portion in the second conveyance path other than the portion between the first optical guide member and the second optical guide member.

6. The image developing device according to claim 5, wherein the second conveyance member is a screw such that blades are attached to the rotation axis of the second member, and wherein no blades are attached to a portion of the rotation axis of the second member corresponding to the optical detection unit in the second conveyance path, in which a portion of the first optical guide member and a portion of the second optical guide member are placed.

7. The image developing device according to claim 6, wherein an upstream blocking member is arranged in an upstream side in the developer conveyance direction of the optical detection unit, the upstream blocking member being configured to regulate a portion of a flow of the developer.

8. The image developing device according to claim 7, wherein the upstream blocking member is a rib formed on an inner wall of the second conveyance path.

9. The image developing device according to claim 8, wherein a height of an upper end of the upstream blocking member is greater than a height of an upper end of the first optical guide member.

10. The image developing device according to claim 9, wherein the upstream blocking member is placed within 10 mm from an end surface in an upstream side in the developer conveyance direction of the first optical guide member.

11. The image developing device according to claim 10, wherein the light emitting plane of the first optical guide member and the entrance plane of the second optical guide member are placed between the rotation axis of the second conveyance member and the inner wall of the second conveyance path, and wherein the upstream blocking member is placed closer to the inner wall of the second conveyance path than the rotation axis of the second conveyance member, wherein the light emitting plane and the entrance plane are placed above the inner wall.

12. The image developing device according to claim 11, wherein a downstream blocking member is arranged at a downstream side in the developer conveyance direction of the optical detection device, the downstream blocking member being configured to regulate a portion of the flow of the developer.

13. The image developing device according to claim 12, wherein the downstream blocking member is a rib formed on the inner wall of the second conveyance path.

14. The image developing device according to claim 5, wherein a distance between an end surface of the second optical guide member in a downstream side in the developer conveyance direction and an end surface of one of the blades attached to the rotation axis of the second conveyance member in the downstream side in the developer conveyance direction of the second optical guide member is less than or equal to 10 mm, wherein the one of the blades is placed closest to the end surface of the second optical guide among the blades attached to the rotation axis of the second conveyance member in the downstream side in the developer conveyance direction of the second optical guide member.

15. The image developing device according to claim 1, wherein the developer is a toner having an accelerated agglomeration degree in a range of greater than or equal to 60% and less than or equal to 95%.

16. The image developing device according to claim 15, wherein an external additive of the toner includes an oil-containing component.

17. A process cartridge that is detachably attached to an image forming device, the process cartridge integrally supporting:

a latent image supporting body configured to support a latent image; and at least one of units selected from a charging unit configured to uniformly charge the latent image supporting body; a developing unit configured to develop the latent image on the latent image supporting body; and a cleaning unit configured to clean the latent image supporting body, wherein the process toner cartridge includes an image developing device including a developer supporting body configured to support a developer and configured to convey the developer to a portion facing a latent image supporting body;

a first conveyance path in which a first conveyance member is arranged, the first conveyance member being configured to convey the developer along an axis line direction of the developer supporting body;

a second conveyance path in which a second conveyance member is arranged, the second conveyance path being configured to convey the developer in a direction opposite to the developer conveyance direction by the first conveyance member, the second conveyance member being arranged above the first conveyance path; and a partition member configured to partition the first conveyance path and the second conveyance path and that has a first communication port and a second communication port, the first conveyance path and the second conveyance path being configured to communicate with each other at a first end portion and a second end portion in the axis line direction through the first communication port and the second communication port, wherein the image developing device includes a developer amount detection unit that includes an optical detection unit arranged in the second conveyance path and configured to optically detect an amount of the developer in the image forming device, and wherein a second developer conveyance speed by the second conveyance member is greater than a first developer conveyance speed by the first conveyance member so that the developer is caused to accumulate in the vicinity of the developer amount detection unit of the image developing device.

18. An image forming device comprising:

a latent image supporting body configured to support a latent image; and an image developing unit configured to develop the latent image on the latent image supporting body, wherein the image developing device including a developer supporting body configured to support a developer and configured to convey the developer to a portion facing a latent image supporting body;

a first conveyance path in which a first conveyance member is arranged, the first conveyance member being configured to convey the developer along an axis line direction of the developer supporting body;

a second conveyance path in which a second conveyance member is arranged, the second conveyance path being configured to convey the developer in a direction opposite to the developer conveyance direction by the first conveyance member, the second conveyance member being arranged above the first conveyance path; and a partition member configured to partition the first conveyance path and the second conveyance path and that has a first communication port and a second communication port, the first conveyance path and the second conveyance path being configured to communicate with each other at a first end portion and a second end portion in the axis line direction through the first communication port and the second communication port, wherein the image developing device includes a developer amount detection unit that includes an optical detection unit arranged in the second conveyance path and configured to optically detect an amount of the developer in the image forming device, and wherein a second developer conveyance speed by the second conveyance member is greater than a first developer conveyance speed by the first conveyance member so that the developer is caused to accumulate in the vicinity of the developer amount detection unit of the image developing device.

* * * * *